US006187259B1

(12) United States Patent
Yamashita et al.

(10) Patent No.: US 6,187,259 B1
(45) **Date of Patent: *Feb. 13, 2001**

(54) METHOD FOR PREPARING RARE-EARTH SYSTEM SINTERED MAGNET

(75) Inventors: Osamu Yamashita; Yoshihisa Kishimoto; Wataru Takahashi; Nobushige Hiraishi; Yoshiyuki Hashimasa; Masakazu Ohkita, all of Osaka (JP)

(73) Assignee: Sumitomo Special Metals Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/793,368

(22) PCT Filed: Jun. 25, 1996

(86) PCT No.: PCT/JP96/01745

§ 371 Date: Mar. 19, 1997

§ 102(e) Date: Mar. 19, 1997

(87) PCT Pub. No.: WO97/01855

PCT Pub. Date: Jan. 16, 1997

(30) Foreign Application Priority Data

| | | |
|---|---|---|
| Jun. 26, 1995 | (JP) | 7-183439 |
| Jun. 26, 1995 | (JP) | 7-183440 |
| Jun. 26, 1995 | (JP) | 7-183441 |
| Jun. 26, 1995 | (JP) | 7-183442 |
| Jun. 26, 1995 | (JP) | 7-183443 |
| Jun. 26, 1995 | (JP) | 7-183444 |
| Jun. 26, 1995 | (JP) | 7-183445 |
| Sep. 5, 1995 | (JP) | 7-254696 |

(51) Int. Cl.[7] ..... C22C 38/36

(52) U.S. Cl. ..... 419/12; 148/104; 148/101; 148/103; 419/32; 419/35; 419/36

(58) Field of Search ..... 148/101, 103, 148/104; 419/12, 32, 35, 36

(56) References Cited

U.S. PATENT DOCUMENTS

| | | | | |
|---|---|---|---|---|
| 3,998,669 | * | 12/1976 | Strnat | 148/103 |
| 5,004,580 | * | 4/1991 | Matsuo et al. | 419/65 |
| 5,288,454 | * | 2/1994 | Lang et al. | 419/38 |
| 5,575,830 | | 11/1996 | Yamashita et al. . | |

FOREIGN PATENT DOCUMENTS

| | | |
|---|---|---|
| 2307963 | 9/1973 | (DE) . |
| 0659508 | 6/1995 | (EP) . |
| 2292802 | 12/1990 | (JP) . |

OTHER PUBLICATIONS

Patent Abstracts of Japan of JP 61 119006, published Jun. 1986, entitled "Manufacture of Sintered Magnet".

(List continued on next page.)

*Primary Examiner*—John Sheehan
(74) *Attorney, Agent, or Firm*—Dykema Gossett PLLC

(57) ABSTRACT

The object of the present invention is to provide rare-earth system sintered magnets such as R—Fe—B system or R—Co system having excellent magnetic properties, unique configuration of a small size, thin wall thickness and intricate geometry. With the method for preparing the present invention, a granulation of alloy powders can be achieved easily, a chemical reaction between rare-earth system and binder substances can be suppressed, so that the residual oxygen and carbon levels in the sintered products can be reduced. Moreover, by this production method, the flowability and lubricant capability during the forming process can be improved. The dimension accuracy and productivity are also enhanced. A certain type of binder is added to rare-earth alloy powders and kneaded into a slurry state. The slurry is then formed into granulated powders by spray-dryer equipment. The thus granulated powders are molded, and sintered through a powder metallurgy technique.

23 Claims, 2 Drawing Sheets

OTHER PUBLICATIONS

Patent Abstracts of Japan of JP 07 130515, published May 1995, entitled "Manufacture of R–Fe–B Sintered Anisotrooopic Permanent Magnet".

Patent Abstracts of Jjjaspan of JP 62 045604, published Oct. 1987 entitled "Manufacture of Rare Earth Sintered Magnet".

* cited by examiner

METHOD FOR PREPARING RARE-EARTH SYSTEM SINTERED MAGNET

TECHNICAL FIELD

The present invention relates to methods to obtain powders which are granulated spherical shapes with high flowability and exhibit excellent magnetic characteristics, and to produce rare-earth system sintered magnets using the thus obtained granulated powders through the powder metallurgy technique. More specifically, the present invention relates to methods for manufacturing rare-earth system sintered magnets possessing unique geometrical features including a small dimension, a thin wall thickness, and an intricate shape with excellent magnetic characteristics through the following subsequent processes; namely, producing a slurry by kneading the alloy powders of this invention and a certain type of binder, spraying and cooling said slurry with the use of sprey-dryer apparatus in order to improve the flowability and lubrication of the alloy powders during the compression forming process, so that the production cycle as well as the dimension accuracy of the final products can be improved.

BACKGROUND ART

Small scale motors or actuators which are mainly utilized in domestic electric appliances, computers, automobiles, or other machineries are required to be produced with a miniatured scale, therefore light weight and high efficiency characteristics are obtained. Accordingly, magnet materials dominantly used for these devices are demanded to be fabricated with a small size, light weight and thin wall thickness. Moreover, in some applications, the magnets are required to be fabricated in more complicated geometries including providing uneven portions at the certain surface area thereof or providing through-holes.

As for the typical types of sintered permanent magnets, there are ferrite magnet, R—Co system sintered magnet, and R—Fe—B system sintered magnet (where R stands for rare-earth system), which the latter was proposed by the present inventors (Japan Patent Publication No. Sho 61-34242; U.S. Pat. No. 4,770,723; EP 0 101 552 B1).

Since rare-earth system magnets such as said R—Co system and R—Fe—B system magnets among the aforementioned magnets exhibit excellent magnetic characteristics compared with other types of magnets, so that they are preferably used in various applications.

Since the rare-earth system magnet, for instance R—Fe—B system sintered permanent magnet, has a maximum energy product ((BH)max) above 40 MGOe, and its maximum value exceeds 50 MGOe, therefore, exhibiting excellent magnetic properties. However, in order to realize such magnetic properties, alloy powders with certain compositions are needed to be pulverized into an average particle size of 1~10 $\mu$m.

However, it should be recognized that when the particle size of alloy powders become smaller, the flowability of said pulverized powders will be deteriorated during molding. This will cause a scatter in the density of the molded products and reduction of the molding machine'life. Moreover, the dimension accuracy of the final sintered products will be scattered, resulting in that fabricating products with small scale and thin wall thickness will become more difficult.

Furthermore, since the rare-earth system magnets contain rare-earth system(s) and iron which are prone to be easily oxidized in an ambient atmosphere, the magnetic properties will be deteriorated due to oxidation, particularly when the particle size becomes smaller. This is more significant for R—Fe—B system sintered magnets, which possess excellent magnetic characteristics when compared to the conventional type of R—Co magnets, because certain type of compounds having a new structure produced by reaction of rare-earth system and B element are very active; said newly produced compound(s) is(are) believed to provide sources for magnetic characteristics. As a result, when the particle size of the alloy powders becomes smaller, the final sintered magnet had drawbacks of the deteriorated magnetic properties as a result of Oxidation.

Hence, for particularly improving the formability, several measures have been proposed; namely, addition of polyoxyethylene-alkylether or the like (Japan Patent Publication No. Hei 4-80961), addition of paraffin or stearic acid salts, besides the aforementioned ether (Japan Patent Publication No. Hei 4-80962, JPP No. Hei 5-53842), or addition of the olefine acid (JPP No. Sho 62-36365).

Although the formability was improved to some extent, it was found that there was a limitation of such improved formability, so that it is still difficult to fabricate products having small scale, thin wall thickness, or intricate shape.

Moreover, as alternative production methods for magnets with characteristic geometrical features including a thin wall thickness and a small scale by adding the aforementioned binder and lubricant for further improvement of the formability, there were additional inventions proposed; namely a production method by which a lubricant made of the myristic acid ethyl or oleic acid and the saturated aliphatic carboxylic acid or unsaturated aliphatic carboxylic acid, is added to the alloy powders prior to molding and kneading, granulated and molding (Japan Patent Application Laid-Open No. Sho 62-245604), and a production process by which the saturated aliphatic carboxylic acid or unsaturated carboxylic acid is added to the paraffin mixture, and molded after granulated and kneaded (JPALO No. Sho 63-237402).

Even with the aforementioned modification, it was found that the bonding strength among powder particles was not sufficiently high enough, and the granulated powder was easily broken, resulting in that a sufficient flowability was not achieved.

In order to enhance the formability or to improve the binding strength of powder particles, it can be done to increase the amount added of various types of binder or lubricant. However, if a large amount of these additives is applied, a residual oxygen as well as residual carbon in the sintered products will increase, due to the fact that the R component in the alloy powder of the rare-earth system and the binder will chemically react. This will cause the deterioration of the magnetic properties. Accordingly, there was a limitation for the amount of adding these additives.

Furthermore, although this is not for the rare-earth system alloy powders, an addition of 1.5~3.5 wt % of methylcellulose and a certain amount of glycerine and boric acid to the alloy powders of Co system superalloy was proposed (U.S. Pat. No. 4,118,480); these additives were used as a binder for the compression molding of the Co system superalloy powder. Moreover, as a binder for a tool steel alloy powder for the injection molding technique, the additive composed of 0.5~2.5 wt % of methyl-cellulose, water, plasticizer such as glycerine, lubricant such as wax-emulsion, and mold-separator was proposed (Japan Patent Application Laid-Open No. Sho 62-37302).

However, the added amount of the aforementioned binder additives is relatively larger than 0.5 wt % in order to maintain a certain level of flowability as well as mold strength. Furthermore, a simultaneous addition of various types of binders such as glycerine with methylcellulose is indispensable, so that a remarkable amount of residual oxygen and carbon can be found even after the injection molding, compression molding, degreasing process, or sintering process. As a result, the residual oxygen and carbon showed an adverse effect on magnetic properties, in particularly the rare-earth system magnets; so that these additives can not be easily applied.

Furthermore, a process is known to add 0.6~1.0 wt % of polyvinylalcohol as a binder to powder having an average particle size of less than 1 $\mu$m for the oxide powders including ferrite or the like, followed by producing granulated powders by the spray-dryer equipment, molding, and sintering.

However, in either aforementioned methods to be used, a large amount of binder with more than 0.6 wt % is added to oxide powders, so that a remarkable amount of residual oxygen and carbon can be found in the sintered products even after the degreasing. Therefore, the aforementioned methods being proposed for the oxide powders cannot be applied to the rare-earth system system alloy powder in the present invention, because said rare-earth system alloy powder contains substances which are very sensitive for oxidation and carbonization; hence once these components are oxidized and/or carbonized, the original magnetic properties will be extensively deteriorated.

Particularly, even if a large amount of binder is used for the oxide powders, a certain amount of residual carbon can be controlled by the degreasing process and the subsequent sintering process in air through which some of residual carbon can be burned out. On the other hand, since the magnetic properties of the rare-earth system alloy powders of the present invention will be adversely influenced by oxidation, degreasing and sintering processes cannot be conducted in air. Hence, a large addition of the amount of binder will have very bad influences on the magnetic properties of the final sintered products.

As discussed in the above, several improvements were proposed to add various binder or lubricant to alloy powders prior to the sintering process, or to improve the formability by the granulation method. Unfortunately, it is difficult to fabricate the rare-earth system magnets having excellent magnetic properties and unique configurations with small scale, thin wall thickness, and/or intricate shape, as currently demanded from various sectors in the technology, through any one of the above mentioned proposed ideas.

DISCLOSURE OF INVENTION

It is, therefore, an objective of the present invention to provide a production method of rare-earth system sintered magnet including R—Fe—B system or R—Co system having excellent magnetic properties and unique configurations such as small scale, thin wall thickness and intricate geometry, by which the present method of the granulated powders necessitated for producing rare-earth system magnets can be produced easily, a chemical reaction between the rare-earth system alloy powders and the binder component can be controlled, amount of residual oxygen and carbon in the final sintered products can be reduced, the flowability and lubricant property during the molding can be improved, and dimension accuracy of the final sintered products and the overall productivity can be enhanced.

After the continuous and diligent efforts in the research and development to achieve the aforementioned objective, the present inventors have found that the rotary-disk type sprey-dryer apparatus was very useful to the present invention, and that a pre-determined average particle size of the granulated powders can be obtained by adding a certain type of binder to the rare-earth system alloy powders, by kneading thereof into a slurry form, and by spraying and drying said slurry. It was also found that, when the thus obtained granulated powders is mold-formed, the flowability of the powders was remarkably improved due to the sufficiently enhanced binding strength between the granulated powders. Accordingly, the rare-earth system sintered permanent magnets can be produced with a satisfactory scatter band in the density of the molded products and without any damage on the molding machine; moreover said sintered magnets possess excellent magnetic characteristics and unique configuration such as a small size, thin wall thickness and complicated shape.

Furthermore, in the aforementioned method, the property of the binder was investigated with which the chemical reaction with the rare-earth system alloy powders can be controlled, the amount of residual oxygen and carbon can be reduced. It was found that the chemical reaction of the rare-earth system alloy powder with the binder can be controlled during the sintering process by using more than one type of polymers, water, and/or organic solvents or a mixture of the organic solvent and methylene chloride, or adding a certain amount of plasticizer besides the aforementioned additives.

Moreover, when the granulation is carried out through the rotary-disk type sprey-dryer apparatus dealing with said binder, even if the addition amount ratio of the binder is less than a 0.5 wt % with respect to a 100 wt % of the alloy powders, the intra-particle binding strength of the primary particles is strong enough to withstand the vibrational force generated in the feeder during the feeding of the powders into the dia cavity. Accordingly, it was found that the flowability of the chemically treated powder mixture is sufficient and the resultant strength of the mold-formed product is satisfactory.

Furthermore, when more than one type of polymer and water are used as a binder, the chemical reaction between the alloy powders and water in the binder component can be controlled during the sintering process by having a hydrophobic pre-treatment on the rare-earth system alloy powders, followed by adding and kneading with said binder. As a result, it was also found that the rare-earth system sintered permanent magnets can be produced with much better magnetic properties.

In the above production method, the chemical reaction between the alloy powders and the solvents contained in the binder component can also be controlled by adding and kneading said binder to the alloy powders at a temperature range between 0° C. and 30° C.

Furthermore, in the aforementioned production method, by mold-forming after adding at least more than one type of aliphatic acid esther or boric acid esther to the granulated powders, the slidability bet ween primary particles after the breakage of the granulated powders is enhanced, so that the magnetic orientation of the powders can be improved. Furthermore, the further improvements on the orientation and ease for breakage of the granulated powders can be achieved by mold-forming after applying the pulse magnetic field with the intensity of more than 10 kOe for one time after feeding said granulated powders into the dia cavity.

Accordingly, it w as found that there was a much smaller scatter in density and weight of the mold products.

Moreover, in the aforementioned method, even in a case when at least one type of aliphatic acid esther or boric acid esther is not added to the granulated powders, if the pulse magnetic field is applied to the granulated powders prior to the mold-forming to break the primary particles and provide a certain orientation, and the powders are compression formed under a static magnetic field and/or pulse magnetic field, it was found that a sufficient orientation along the C-axis of the primary particles of the granulated powders can be obtained, and the flowability of the powder body is extremely improved along with the lubricant property of the binder per se. Hence, the rare-earth system sintered permanent magnets can be produced with an excellent magnetic property and without any reduction in the life of the molding machine with less scatter of the density of the mold. Moreover, in the above production method, it was also found that the following conditions appear to be suitable; namely, more than 15 kOe of the pulse magnetic field applied prior to the mold-forming, 8~15 kOe of the static magnetic field and/or more than 15 kOe of the pulse magnetic field during the compression mold-forming.

Furthermore, in the aforementioned production method, the binder will be softened, after the granulated powders are fed into the dia cavity by punching, by pressing for more than 0.5 seconds under less than 100 kg/cm$^2$. This pressing was accompanied by applying ultrasonic vibration with the frequency of 10~40 kHz, an amplitude of less than 100 $\mu$m to the dia cavity and/or punch, followed by stopping the ultrasonic vibration and subsequently pressing at more than 100 kg/cm$^2$. Besides, by the above procedures, the direction—in which the magnetization can be easily achieved—of the primary particle in the mold can easily be orientated along the applied magnetic field; hence the magnetic orientation can be enhanced, resulting in that the rare-earth system sintered permanent magnets can be produced with excellent magnetic properties with a unique geometry of small scale and thin wall thickness.

By the production method of rare-earth system sintered permanent magnets according to the present invention, a binder consisted of at least one type of polymer and water, or organic solvents and polymer which is soluble to said organic solvents, or plasticizer if required is added and kneaded to rare-earth system alloy powders comprising of R—Fe—B system alloy or R—Co system alloy in order to form a slurry. The thus prepared slurry is granulated into spherical particles having a high flowability by the spray-dryer equipment. Prior to the compression forming of the granulated particles, the granulated particles are subjected to the pulse magnetic field to break the primary particle bonding and to have a preferred orientation. Then the particles are compression formed under a static magnetic field and/or pulse magnetic field, followed by sintering and heat-treatment. Accordingly, the flowability of powders along with the excellent flowable binder in the granulated particles can be improved, resulting in an enhanced forming cycle. Moreover, the scatter in the density of the formed products is lowered and the life of the forming machine can also be prolonged. Furthermore, by the applying effect of the pulse magnetic field, the direction for being easily orientated of the primary particle in the formed body can be easily orientated along the applied magnetic field; hence the magnetic orientation can be improved. As a result, rare-earth system sintered permanent magnets can be produced with a reduced amount of residual oxygen and carbon, with excellent magnetic properties and unique configuration including a small size, thin wall thickness as well as intricate shape.

BRIEF DESCRIPTION OF DRAWINGS

The above and many other objectives, features and advantages of the present invention will be fully understood from the ensuing detailed description of the examples of the invention, which description should be read in conjunction with the accompanying drawings.

BEST MODE FOR CARRYING OUT THE INVENTION

Rare-earth System Alloy Powder

Figure 1:
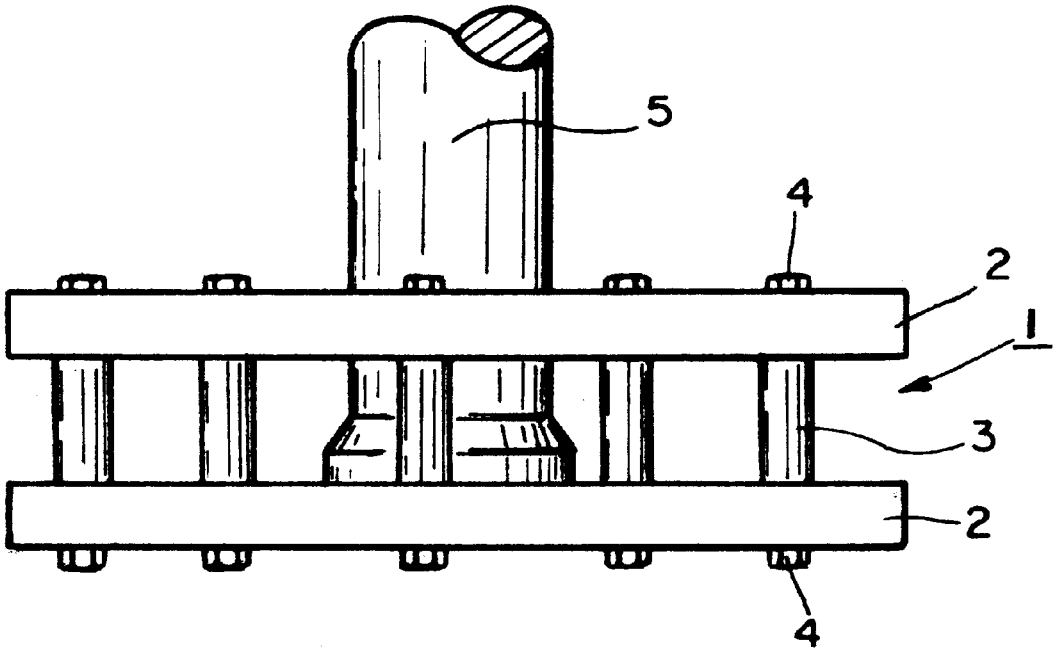
FIG. 1 shows a partial view showing a rotary portion of the rotary-disk type sprey-dryer apparatus according to the present invention.

Although the rare-earth system alloy powders which are proposed to be utilized in the present invention can include compositions containing rare-earth system R, alloy powders with which elements other than rare-earth system involved in R—Fe—B system, R—Co system or the like alloy powder is substituted by non-rare-earth element can be applicable; for example, Fe in R—Fe—B system alloy powder can be substituted by a transition element such as Co, and B in said R—Fe—B system alloy powder can be replaced by a semi-metallic element such as C or Si.

Particularly, as for the rare-earth system system alloy powders, (1) powders which are granulated from a single alloy system comprising of a certain composition, (2) powders which are prepared to provide a mixture of various granulated alloy powders having different compositions, or (3) powders which are modified in terms of improved coercive force or enhanced productivity can also be utilized as starting powders; these may include a prior art type powders such as R—Fe—B or R—Co system alloy powders.

Moreover, for the production method for the above mentioned various types of alloy powders, any one of prior art technologies can be appropriately chosen; namely, they include a melting-granulation method, a rapid-cooling method, a direct reduction diffusion method, a hydrogen-involved crushing method, or an atomizing method. Although the particle size is not specifically defined, it is preferable to limit the particle size range from 1 to 10 $\mu$m; particularly it would be more preferable to have particle size ranging from 1 to 6 $\mu$m. The basic reasoning for the particle size ranges is based on the facts that (1) if the average particle size is less than 1 $\mu$m, the particles easily react with oxygen in air, binder component, or solvents to be oxidized, resulting in unwanted reduction of the magnetic properties after sintering process, on the other hand, (2) if the average particle size is more than 10 $\mu$m, the sintered density will be saturated at about 95% and further consolidation can not be expected.

Binder

The following four types of binders are used in the present invention;

(1) binder comprising of at least more than one type of polymer and water,
(2) binder comprising of at least more than one type of polymer and an organic solvent,
(3) binder comprising of at least more than one type of polymer, an organic solvent, and methylene chloride, and
(4) binder comprising of at least more than one type of polymer, an organic solvent, and water.

A preferable polymer which is included in the above binder (1) can be properly selected from a group consisted of ployvinylalcohol, polyacrylamide, water-soluble cellulose ether, polyethylene oxide, water-soluble polyvinylacetal, polyacryl acid, and polyacryl acid derivative.

Among the above listed polymers, the polyvinylalcohol appears to be the most suitable to the present invention since it can easily be dissolved in water, exhibits a strong adhesive strength, shows a good chemical stability as well as thermal decomposition, possesses an excellent lubricant property during the compression forming, and can be commercially available with low cost.

In order to maintain the aforementioned characteristics during the usage, it is preferable to use a polymer which has 4% aqueous solution concentration of 3~7 cps at 20° C., as a guideline for the polymerization. If the polymer has less than 3 cps polymerization, the maximum breakage strength of the polymer per se is low, the intra-particle binding strength of the granulated powders is reduced, and a complete granulation cannot be achieved, so that a fine powder can remain as a primary particle. On the other hand, if the polymer shows a polymerization with more than 70 cps, the viscosity of the slurry will increase tremendously, resulting in that it would be very difficult to supply the polymer steadily to the spray-dryer and the productivity will be remarkably deteriorated.

Furthermore, it is preferable to have the saponification degree of 70~99 mol %. Under less than 70 mol % of saponification degree, the original properties associated with the polyvinyl-alcohol cannot be obtained due to excessive presence of residual acetyl radicals. On the other hand, it is very difficult to obtain the polymers having the saponification degree with more than 99 mol %.

Polyacrylamide appears to be suitable to the present invention since it can easily be dissolved in water, exhibits a strong adhesive strength, shows a good chemical stability as well as thermal decomposition, possesses an excellent lubricant property during the compression forming, and can be commercially available with low cost.

In order to maintain these excellent characteristics of the polyacrylamide, it is preferable to have polymers with average molecules ranging from several thousand to one million. If the polymer has less than several thousand molecules, the maximum breakage strength of the polymer per se is low, the intra-particle binding strength of the granulated powders is reduced, and a complete granulation cannot be achieved, so that a fine powder can remain as a primary particle. On the other hand, if the polymer shows a polymerization with more than one million molecules, the viscosity of the slurry will increase tremendously, resulting in that it would be very difficult to supply the polymer steadily to the spray-dryer and the productivity will be deteriorated to a great extent.

Cellulose ether is a compound in which a portion of three hydroxy radical (—OH) in the cellulose skeleton is altered to ether by an ether altering substance and the ether radical (—OR) instead of hydroxy radical is introduced. They may include methylcellulose ($R:CH_3$), ethylcellulose ($R:C_2H_5$), benzenecellulose ($R:CH_2C_6H_5$), cyanogenethylcellulose ($R:CH_2CH_2CN$), trithylcellulose ($R:C(C_6H_5)_3$), carboxylmethylcellulose ($R:CH_2COOM$, where M is a mono-valent metal or an ammonium radical), water-soluble carboxyalkylcellulose derivative, hydroxypropylcellulose ($R:CH_2CH(OH)CH_3$), or hydroxy-ethylcellulose ($R:CH_2CH_2OH$). There are also hydroxypropylcellulose ($R:CH_2CH_2OH$, $CH_3$, $CH_3$), hydroxyethylmethylcellulose ($R:CH_2CH_2OH$, $CH_3$) which have a plurality of substituting radicals. Hence, by properly selecting the substituting radicals and degree of substitution, various other types of polymers are available.

These types of cellulose ether are suitable since they have excellent water-solubility and viscosity, and possess an interfacial activity and chemical stability. Although the polymerization degree depends on the type of ether altering and extent of substitution, it is preferable to have a polymer with 2% aqueous viscosity of 10~20,000 cps at 20° C. If the polymer has less than 10 cps polymerization, the maximum breakage strength of the polymer per se is low, the intra-particle binding strength of the granulated powders is reduced, and a complete granulation cannot be achieved, so that a fine powder can remain as a primary particle. On the other hand, if the polymer shows a polymerization with more than 30,000 cps, the viscosity of the slurry will increase tremendously, resulting in that it would be very difficult to supply the polymer steadily to the spray-dryer and the productivity will be remarkably deteriorated. A single- or multiple-phase of the aforementioned polymers can be used. It is also possible to duplicate-add cellulose ethers. The preferable combination will be; methylcellulose+hydroxypropyl-methylcellulose, or methylcellulose+hydroxyethylmethylcellulose.

Polyethyleneoxide can easily be dissolved in water, and does not change to gel by applying heat; hence a good thermal decomposition. Moreover, the polyethyleneoxide has an excellent dispersibility of powders during the slurry production process, and good lubricant property during the press-forming procedure. Accordingly, it is suitable for the present invention.

In order to maintain these suitable properties, it is preferable for said polymer to have an average molecular weight between 20,000 and several millions. If the polymer has less than 20,000 molecules, the wax-stage of the polymer itself will change to a liquid-form, hence the strength of the polymer is not sufficient. As a result, the binding force for the alloy powders after drying in the granulation process is not sufficient and a perfect granulation cannot be achieved, rather fine powders will be remaining.

On the other hand, if the polymer has more than several million molecules, although the binding strength is enhanced, the aqueous solution viscosity will also be remarkably increased. Hence, even if a small amount of said polymer is added to the slurry, the resultant viscosity of the slurry will increase, causing the unstable supplying condition of the slurry to the rotary-disk and a particle distribution of the granulated powders will not be satisfactory. Furthermore, polymers with such high molecule are not commonly used and produced. Even if they are available, it would not be economical.

Water-soluble polyvinylacetal is a polymer which can be obtained by a condensation reaction of polyvinylalcohol and aldehyde. The characteristics of the polymers produced through this condensation reaction depends on the molecular weight of polyvinylalcohol as a starting material, degree of saponification, and degree of the acetal altering. If any of the polymers exhibit a certain level of slurry viscosity and degree of dispersibility along with a satisfactory binding strength, the present invention is not constrained with the above limitations. However, in general, it is preferable to have polymers which are prepared under the following conditions; namely, the degree of saponification is in a range of 70 to 99 mol %, molecular weight of polyvinylalcohol is ranged from several hundred to several thousand, and acetal altering is between several mol % to several ten mol %.

Polyacryl acid and polyacryl derivative are water-soluble polyacryl acid, polymethacryl acid and metallic salts and ammonium salts thereof. Polyacryl acid and polymethacryl acid are amorphous and very hard polymers. Hence, they can provide a sufficient binding force to the alloy particles and enhance the granulation ability by a small amount of addition. Moreover, although the mechanical strengths of their salts are slightly lower than those in the above polymers, these salts show a de-gelation effect, so that the homogeneity of the slurry can be improved during the slurry producing process.

For water used in the binder (1), it is preferable to use water that is purified through the de-oxygen treatment or is bubbling-treated by an inert gas such as nitrogen in order to control the reaction with the rare-earth system in alloy powders as much as possible.

For the preferable type of polymers suitable for the binder, if it is soluble in an organic solvent, it is acceptable, regardless of chemical structure and molecular weight. However, preferably, the following characteristics are required.

a. Chemical Stability

It should be stable against alloy powders; namely the binder should not easily react with the alloy powders during the slurry kneading and granulated powders. Moreover, the binder should not be altered chemically and physically through any reactions such as oxidation, dissolution or bridging with organic solvents and plasticizers.

b. Organic Solvent Solubility

The binder is needed to be easily dissolved in organic solvents and should exhibit a range of viscosity required for a stable supply of slurry to the spray-dryer equipment in the granulation process. For example, at 1 weight % concentration, it is preferable to have a viscosity less than 100 cps. If the polymer has more than this viscosity, the slurry supply will become unstable; and on the other hand, it is necessary to reduce the slurry concentration to a great extent, resulting in that it would be very inefficient.

c. High Intra-particle Binding Strength

In order to conduct the granulation of alloy powders easily, it is required that the polymer itself should possess a high intra-particle binding force with respect to the alloy powders. Namely, it is required for the polymer to show rigid mechanical properties and a high adherency to alloy powders.

It is technically difficult to measure the aforementioned intra-particle force quantitatively. Hence, for a rough estimation of the force, the polymer film is made through the thermal press or solvent casting method, and the polymer film is subjected to the fracture strength tests.

It is preferable to have the polymer with the thus obtained failure strength higher than 0.5 kgf/mm$^2$ measured at 20° C. Under a condition when the polymer has the fracture strength less than 0.5 kgf/mm$^2$, the granulation will be insufficient, so that the ungranulated raw powders will be mixed, or it is required to increase the amount of polymer to enhance the granulation efficiency. As a result, the obtained final sintered product will contain a great amount of residual carbon, causing the reduction of magnetic properties.

d. Softening Temperature

The softening temperature relates to the intra-particle force. In order to store the produced granulated powders at room temperature and be subjected to a room temperature pressing later on, it is necessary for the softening temperature to be higher than the room temperature to maintain the required intra-particle force at room temperature.

Practically, in a case when the plasticizer is added in order to improve the magnetic orientation as described later on, it is preferable to set the softening temperature to be higher than 30° C., more preferably higher than 50° C., if it is taken into consideration that the softening temperature will be slightly reduced due to the adding effect.

Although the upper limit of the softening temperature is not particularly set, it would be preferable to be lower than 200° C. for the following reasons. Namely, when the ultrasonic wave is applied during the press forming process, the granulated powders is softened through the thermal energy by the applied ultrasonic wave in order to enhance the magnetic orientation.

If the polymer, according to the present invention, meets the aforementioned requirements, there is no specific limitations in terms of chemical structure or molecular weights. However, after taking into consideration the above mentioned mechanical and physical requirements, the following types of polymers will be preferably selected; monopolymers such as polymethacryl acid methyl, polymethacryl acid butyl, acrylic resins including acrylic acid cyclohexyl, polystylene resins, polyacetic vinyl resins, polyvinyl acetal resins, polyvinylbutylal resins, methylcellulose, cellulose ether groups including hydroxypropylcellulose, polycarbonate resins, and polyacrylate resins; and copolymers such as ethylene acetic vinyl copolymers, ethylene-acrylate copolymers, styrene-methylacrylate copolymers.

The organic solvent, which is used for the binder type (2), can be properly selected for more than any one of the polymers listed in the above. Namely, the selected organic solvent should have a sufficient solubility with respect to the polymer, and exhibit a chemical stability against the polymer and alloy powders. From the industrial standpoint for stable production of the granulated powders, it is preferable to choose the organic solvent which has a boiling temperature in the range of 30° C. and 150° C. at the atmospheric pressure.

If the boiling temperature is less than 30° C., the organic solvent will volatile with a great extent in the kneading process of the slurry, so that it is not only difficult to maintain the constant concentration of the slurry, but also the resultant slurry will become inhomogeneous. On the other hand, if the organic solvent which have the boiling temperature higher than 150° C. is utilized, it will require a relatively high temperature to dry the granulated powders in the spray-dryer process, so that the drying process will be prolonged and the efficiency of the granulated powders will become lower.

Basically, the preferable type of polymers for the binder (3) is similar to those selected for the binder type (2). In particular, polyacetic vinyl resins and/or cellulose ether groups are suitable.

A small additive amount of polyacetic vinyl resins and/or cellulose ether groups is sufficient enough to enhance the viscosity of the slurry. Besides, the high bonding force can be maintained even after the dying. Moreover, the amount of residual oxygen and carbon in the powders can be minimized.

Especially, by using polyacetic vinyl resins, the viscoelasticity takes place in the secondary particle in the granulated powders produced in the spray-dryer equipment, so that even if the secondary particles are not fractured, the powders can be formed with a condition such that the primary particle is rotated along the magnetic field. As a result, the C-axis orientation during the forming in magnetic field is enhanced, the residual magnetic flux is improved, and the maximum energy product (BH)max is also enhanced. Furthermore, if the cellulose ether groups is admixed, the binding force of the secondary particle is reduced, the average particle size of the granulated powders is also reduced, so that the flowability of the powder body will decrease, resulting in that a phenomenon of loosing the granulation effect can be avoided.

Incidentally, although it is not necessary to define the volume ratio between polyacetic vinyl resins and cellulose ether groups, it would be better to increase the amount of polyacetic vinyl when the strength of the sintered product is required to be stronger.

It is preferable to choose the ethanol or methanol as an organic solvent for the binder type (3). When compared to water, ethanol or methanol is more difficult to be reacted with the rare-earth system alloy powders. Moreover, because of a lower surface tension, generation of bubbles can be prevented during the stirring process. Although there is no special requirement for selecting a certain type of ethanol or methanol, anhydride ethanol or anhydride methanol will be preferably chosen, in order to control the reaction with rare-earth system in the rare-earth system alloy powders, when either ethanol or methanol is going to be used independently.

Ethylene chloride is employed when cellulose ether which is more difficult to be solved into ethanol or methanol is used. For example, cellulose ether is dissolved into the ethylene chloride and is kneaded with a certain type of solvent.

In the binder type (3), by using an ethanol or methanol having a lower boiling temperature and furthermore kneading with the ethylene chloride, the treatment efficiency can be doubled when compared to a case when only water is used under the same conditions, because the aforementioned mixture of the solvent evaporates faster during the spraying in the sprey-dryer apparatus for granulation purpose. Moreover, since the amount of water content is less than 0.02 wt %, which is very small, granulated particles are not agglomerated and have an excellent flowability. Furthermore, they are not oxidized in an atmospheric condition, so that operational efficiency of the forming process can be enhanced.

Alternatively, when polyacetic vinyl resin is dissolved into ethanol or methanol, or polyacetic vinyl is dissolved into a mixture of ethanol or methanol and ethylene chloride, it can be done to produce the granulated particles by using the binder in which the aforementioned organic solvent is kneaded to a certain amount of more than any one of the following substances listed below; benzene, toluene, xylene, o-xylene, m-xylene, p-xylene, ethylbenzene, dimethylebenzene, tetrahydrofuran, dioxan, diethylene glycol diethylether, diethylene glycol diethylether, diethylene glycol dibutylether, acetone, methylethylketone, 2-pentanon, 3-pentanon, 2-hexanon, methylisobutylketone, cyclohexanon, acetic methyl, acetic ethyl, acetic propyl, acetic isopropyl, acetic butyl, acetic isobutyl, acetic sce-butyl, chloroform, carbon tetrachloride, 1,1-dichloroethane, 1,2-dichloroethane, 1,1,1-trichloroethane, 1,1,2-trichloroethane, 1,1,1,2-tetrachloroethane, 1,1,2,2-tetrachloroethane, 1,2-dichloropropane, chlorobenzene, o-dichlorobenzene, m-dichlorobenzene, p-dichlorobenzene, 1,2,4-trichlorobenzene, o-chlorotoluene, 1-propanol, 2-propanol, 1-butanol, and 2-butanol.

Furthermore, when polyacetic vinyl resins and cellulose ether groups are dissolved in either ethanol or methanol, or they are dissolved in a mixture of ethanol or methanol with ethylene chloride, the granulation can be conducted by using a binder in which the aforementioned organic solvent is dissolved into a certain amount of more than any one of the following listed substances; chloroform, carbon tetrachloride, ethyl chloride, 1,1-dichloro-ethane, 1,2-dichloroethane, 1,1,1-trichloroethane, 1,1,2-trichloro-ethane, 1,1,1,2-tetrachloroethane, 1,1,2,2-tetrachloroethane, 2-propanol, and 1-butanol.

Moreover, when cellulose ether is dissolved in ethanol or methanol, or dissolved in a mixture of ethanol or methanol with ethylene chloride, it is possible to produce the granulated powders by using a binder in which the aforementioned organic solvent is kneaded with a certain amount of more than any one of the following listed substances; chloroform, carbon tetrachloride, ethyl chloride, 1,1-dichloroethane, 1,2-dichloroethane, 1,1,1-trichloro-ethane, 1,1,2-trichloroethane, 1,1,1,2-tetrachloroethane, 1,1,2,2-tetrachloroethane, ethyl bromide, ethanol, 2-propanol, 1-butanol, benzyl alcohol, formic acid, acetic acid, propionic acid, butyric acid, isobutyric acid, aniline, N-methyl aniline, piperidine, N,N-dimethyl formaldehyde, N,N-diethyl formaldehyde, dimethyl sulfoxide, and epichlorohydrine.

The preferable type of polymers suitable for the binder type (4) is basically similar to those for binder types (1) and (2). Particularly, the cellulose ether groups will be suitable.

Moreover, the organic solvent for the binder type (4) will be preferably ethanol or methanol, similarly used for the binder type (3).

In the binder type (4), water can increase the flash point of the solvent, and therefore improves the safety. In order to control the reaction with the rare-earth system in the rare-earth system alloy powders as much as possible, water should be pure water, which is de-oxygen treated, or a treated water by a bubbling treatment with an inert gas such as nitrogen gas.

The granulation can be performed by using a binder in which the aforementioned organic solvent is kneaded with a certain amount of more than any one type of the following listed substances; methylene chloride, chloroform, carbon tetrachloyoide, ethylene chloride, 1,1-dichloroethane, 1,2-dichloroethane, 1,1,1-trichloro-ethane, 1,1,2-trichloroethane, 1,1,1,2-tetrachloroethane, 1,1,2,2-tetrachloroethane, 2-propanol, and 1-butanol.

Even if more than any one type of polymers involved in the binders type (1) through (4) is used less than a 0.5 wt % with respect to a 100 wt % of alloy powders, it was recognized that the intra-particle binding strength of the primary particles which is high enough to withstand the vibrational movement in the feeder which is employed for supplying the powders into the dia cavity, and sufficient flowability and strength of the mold are achieved.

Moreover, a homogeneous and uniform slurry can be obtained at even small amount of addition. It is also easily done to adjust the appropriate viscosity in order to conduct the spray-granulation process. Furthermore, even after the drying, an original high bonding strength can be maintained. Since the small amount of addition is still sufficient, the amount of residual oxygen and carbon can be reduced.

According to the present invention, the addition amount of more than one type of polymers used in the binder type (1) through (4) can be set in a range of 0.05~0.7 weight fraction, preferably 0.05~0.5 weight fraction, with respect to 100 wt % of the rare-earth system system alloy powders.

If the addition amount is less than 0.05 weight fraction, the intra-particle binding strength will become weaker, and ungranulated particles might be kneaded into the powders. Accordingly, the granulated powder will be broken during the supplying of the powders to the forming machine, and the flowability of the powder body will be remarkably deteriorated. On the other hand, if the addition amount exceeds 0.7 weight fraction, the amount of residual oxygen and carbon in the sintered products will increase, causing the reduction of coercive force and deterioration of the magnetic properties.

In the slurry production process, according to the present invention, by which binder (1) through (4) is added to the rare-earth system alloy powders and kneaded, the slurry concentration can be selected properly depending on the slurry viscosity, dispersibility of alloy powders, and a treatable amount in the slurry granulation process. In general, it is preferable to choose the concentration of the alloy powders in the slurry to be in a range of 40~80 wt %.

If the alloy powder concentration is less than 40 weight %, a solid-liquid separation will take place in the stirring-kneading process, causing the reduction of the dispersibility of the slurry, and the forming nonuniform slurry. Moreover, unwanted sedimentation will occur inside the supplying pipes while supplying slurry granulated powders to the spray-dryer. As a result, the fine ungranulated powders will mix, or nonspherical granulated powders will be produced. On the other hand, if the concentration exceeds 80 wt %, the slurry viscosity will increase with a great extent, so that a uniform stirring and kneading cannot be accomplished, and said slurry cannot be supplied from the stirring-kneading bath to the spray-dryer.

In a case of the binder type (1) when the binder is consisted of water and more than one type of polymer, by adding and mixing said binder after hydrophobic pretreatment on rare-earth system alloy powders, the chemical reaction between water component involved in the binder and the alloy powders can be suppressed in the process prior to the sintering. Accordingly, it is possible to produce the rare-earth system sintered permanent magnets with further excellent magnetic characteristics.

As for the method of hydrophobic treatment on surface areas of the alloy powders, although the simplest method is available to introduce the chemical compound having a hydrophobic radical onto the surface areas of alloy-powders, this method has several drawbacks, as described below. When the surface area of alloy powders are binded with the hydrophobic compounds through the chemical bond, although the strong hydrophobic property can be obtained, said chemical bond is hard to separate during the debinder and sintering processes, leaving as a metallic carbides or the like, so that the amount of residual carbon level will increase. As a result, the magnetic properties (such as residual magnetic flux, and inherent coercive force) will decrease. Accordingly, in the present invention, it was found that it is preferable to employ a method by which a chemical compound having a hydrophilic radical is coating-adsorbed onto the surface area of alloy powders.

As for the chemical compound having the hydrophobic radical to coat the surface areas of alloy powders, the following properties are required; namely, they include having a sufficient hydrophobic radical, having inertness against the alloy powders, a good coating capability to the surface areas of alloy powders, and capability to be decarbonization. Although if any substances satisfy these requirements, there would not be any limitations for the material selection, it is preferable to use substances having long-chain saturated (or unsaturated) aliphatic radicals as a hydrophobic radical in order to provide the hydrophobic property onto the surface areas of alloy powders.

For example, there are some available such as hydrocarbon ($C_{12}$~$C_{30}$), saturated (or unsaturated) aliphatic acids ($C_{12}$~$C_{30}$), saturated (or unsaturated) aliphatic acid amido ($C_{12}$~$C_{30}$), saturated (or unsaturated) aliphatic acid ester ($C_{12}$~$C_{30}$), metallic soap of saturated (or unsaturated) aliphatic acid ($C_{12}$~$C_{30}$), and saturated (or unsaturated) aliphatic acid alcohol ($C_{12}$~$C_{30}$).

For a more detailed description of these potential substances, as for the hydrocarbon system compounds, there are flowable paraffin (about $C_{12}$~$C_{20}$), and paraffin wax ($C_{20}$~$C_{30}$).

For aliphatic acid system compounds, there are myristic acid, palmitic acid, stearic acid, oleic acid, arachidic acid, and behenic acid.

As for the aliphatic acid amido system compounds, there are mono amides including stearyl amido, palmityl amido, and oleil amido, and diamide including methylene bis-stearo amido, and ethylene bis-stearo amido.

For the aliphatic acid ester system compounds, there are mono-valent aliphatic acid alcohol ester groups including stearic acid ethyl, stearic acid butyl, palmitic acid butyl, myristic acid butyl, oleic acid butyl, oleic acid hexyl, and oleic acid octyl, and poly-valent alcohol ester groups including ethylene glycol monostearate, ethylene glycol di-stearate, glycerine monostearate, and glycerine polystearate.

As a metallic soap of aliphatic acid groups, there are salts of Li, Mg, Ca, Sr, Ba, Zn, Cd, Al, Sn, or Pb in the uraline acid, stearic acid, palmitic acid, ricinolic acid, and naphthenic acid.

As for the aliphatic acid alcohol system compounds, there are lauril alcohol, stearil alcohol, cetyl alcohol, and myristyl alcohol. Moreover, as natural waxes containing these components, there are carnauba wax, candellila wax, bee's wax, whale wax, ibota wax, and montan-wax.

In order to provide the hydrophobic property to the rare-earth system alloy powders, at least one type of aforementioned substances for hydrophilicity is in a dispersible manner kneaded with rare-earth alloy powders to coat the hydrophobic substance on the surface areas of the rare-earth system alloy powders. It is followed by producing the thus treated powders into slurry-form to make granulated powders. Then the granulated powders will be subjected to the press-forming to fabricate the sintered permanent magnets. The timing for kneading the hydrophobic treating substances to alloy powders can be anytime before crushing the rare-earth system alloy powders, during the crushing process, or after the crushing.

The amount of the aforementioned hydrophobic treating substance added to the rare-earth system alloy powders can be chosen depending on various parameters, including oil-philic property of the hydrophobic substances, particle size of the raw alloy powders, kneading and kneading conditions for slurry, and conditions for granulation. If the amount is too small, the expected effect of the hydrophobic treatment cannot be achieved on the surface areas of the alloy powders, so that the suppressing effect of the oxidation taken place by a reaction with water is not sufficient. On the other hand, if the addition amount is too much, the excess amount of the hydrophobic substance is very hard to be separated from the surface areas of the alloy powders after the debinder and sintering processes, causing an increase of residual carbon and reducing the magnetic properties. From the above standpoints, it is preferable to select the addition range from 0.01 to 2 weight fraction, with respect to 100 wt % of the rare-earth system alloy powders; more preferably it is in a range of 0.02 to 1.0 weight fraction.

Moreover, in the present invention, either the wet kneading method using a solvent or a dry kneading method can be employed in order to mix the hydrophobic substance onto the alloy powders. However, in order to have a uniform distribution of relatively small amount of the hydrophobic substance over the alloy powders, and to provide an appropriate hydrophobic property thereon, it is preferable to use the dry kneading method which can be operated easier. Furthermore, the timing for the addition-mixing can be either before or after the crushing process, or during the crushing operation. It is suitable to conduct the mixing-coating the substances at a temperature range between room temperature and 50° C.

By adding the plasticizers to the binder types (1) through (4), it is possible to permanently plastic-deform the morphology of the powders under relatively small applied force when the granulated powders are subjected to the press-forming.

Namely, since the polymers employed in the present invention possess high intra-particle binding force for making the granulation process easy, the capability of maintaining the shape is excellent. On the other hand, even when the granulated body is pressed, said shape-holding capability is maintained, so that the density of the pressed body will decrease. Moreover, under the circumstances when being pressed in the magnetic field, the powders are not completely orientated due to the excellent intra-particle binding force. As a result, the residual magnetic flux of thus obtained sintered body will reduce, and the magnetic properties will be deteriorated.

The plasticizers are added in order to reduce the intra-molecular interaction in the polymer chains, and to reduce the glass transition temperature. The plasticizers can be properly selected from commercially available compounds, depending on various factors listed below; namely, they include plasticizing effect, solubility with polymers, chemical stability, physical properties (boiling temperature, vapor pressure), and reactivity with alloy powders. They include, for a case of water-system slurry using the binder type (1), ethylene glycol, trimethyl glycol, tetramethyl glycol, pentamethyl glycol, hexamethyl glycol, propylene glycol, glycerine, butane diore, diethylene glycol, and triethylene glycol.

In a case of the organic solvent system slurry using the binder types (2) through (4), they are phthalic ester system plasticizers such as dibutyl phthalate, dioctyl phthalate, or butylbenzyl phthalate, ester phosphate system plasticizers such as tricresil phosphate, trioctyl phosphate, triphenyl phosphate, octyl didiphenyl phosphate, or cresildiphenyl phosphate, adipic acid ester system plasticizers such as dioctyl adipate or diisodecyl adipate, sebacic acid ester system plasticizers such as dibutyl sebacate or dioctyl sebacate, azelaic acid ester system plasticizers such as dioctyl azelate or dihexyl azelate, citrate ester system plasticizers such as triethyl citrate, triethyl acetyl citrate, or tributyl citrate, glycollic acid ester system plasticizers such as methylphthalyl ethyl glycolate, ethylphthalyl ethyl glycolate, or butylphthalyl butyl glycolate, or trimellitic acid ester system plasticizers such as tributyl trimelate or trioctyl trimelate.

Although the addition amount of the plasticizers can be appropriately chosen according to the above listed characteristics, it is preferable to add in a range of 2 to 100 wt % with respect to 100 wt % of polymers which is added to the slurry; more preferably it would be a range from 5 to 70 weight fraction. If the addition amount is less than 2 wt % with respect to the 100 wt % of the polymers, it is not sufficient enough to achieve the plasticizing effects and will not enhance the orientation in the applied magnetic field, so that the magnetic property (particularly, residual magnetic flux) of the resultant sintered product will decrease. On the other hand, if more than 100 wt % is added, the intra-particle binding force will be reduced. Besides, the granulation is reduced and the flowability of the powders will also be reduced. Moreover, since this type of water-soluble plasticizers has, in general, a high moisture-absorption, the dryness in the granulation process will reduce and the residual water component will be increased in the powders, causing unwanted oxidation and wetting during the storage of the powders.

Furthermore, if necessary, it is possible to add de-gelation substance (dispersion substance), lubricant, de-foaming substance, or surface treating substance with a certain amount such that no additional increment in residual carbon level is in the sintered products.

For example, by adding at least one type of dispersion substances including glycerine, wax emulsion, stearic acid, phthalic acid ester, petryol, or glycol and lubricant to the binder and/or by adding a de-foaming agent such as n-octylalcohol, polyalkylene derivative, or polyether system derivative, the dispersibility and homogeneity of the slurry will be enhanced, and the powdery condition inside the sprey-dryer apparatus will also be improved. Hence the porosity is reduced, and granulated powders with excellent slidability and flowability can be obtained.

Since the addition amount of less than 0.03 weight % will not exhibit any effective mold-separation capability from the mold after the forming, and the addition amount of more than 0.3 wt % will cause the increment of residual oxygen and carbon level in the final sintered products, causing the coercive force and other magnetic properties to decrease, then it is preferable to add in a range of 0.03 wt %~0.3 wt %.

In the present invention, it is preferable to add the binder into the rare-earth system alloy powders and stir the slurry at a temperature ranging from 0° C. to 30° C., so that the chemical reaction between the alloy powders and water component can be controlled. If the stir is operated at a temperature exceeding 30° C., the oxidation reaction between water and alloy powders will adversely be accelerated, resulting in that the residual oxygen level in the sintered product will increase and the magnetic properties will be deteriorated. Accordingly, it is necessary to keep the stirring operation at a temperature range of 0° C. to 30° C. In order to maintain the aforementioned temperature range, the water which was previously cooled at the temperature range is used, or the stirring bath is cooled by the cooling water.

For a case of binder types (2) through (4) using organic solvents, it is preferable to conduct the adding process of the binder to the rare-earth system alloy powders and the stirring process of said slurry at a closed condition, in order to suppress the evaporation of said organic solvents, to keep the slurry concentration constant, and to stabilize the powder characteristics of the granulated powders.

Spray-dryer Equipment

In the present invention, the slurry in which the binder is added and kneaded to the aforementioned alloy powders, is subjected to the granulation process in the spray-dryer equipment. First of all, the method for preparing the granulated powders using the sprey-dryer apparatus will be described, The slurry will be supplied from the slurry stirrer to the spray-dryer equipment. For example, it will be sprayed by using the centrifugal force of the rotary-disk, or sprayed through the distal portion of the pressurized nozzle. The thus sprayed droplets are dried immediately by the heated inert gas, and let fall down and recovered at the bottom of the recovery chamber.

In the present invention, although there are several different types of the rotary-disks available such as vane-type, Chestner-type, or pin-type, the mechanical principle of any one of these is similar to each other. Namely, it is structured with a pair of upper and lower disks, which rotates.

The prior art of open-type sprey-dryer apparatus can be employed as spray-dryer equipment. However, since the rare-earth system alloy powders to be granulated are easily oxidized, it is preferable to use the closed-type sprey-dryer apparatus with which the atmosphere inside the slurry storage chamber or recovery chamber of said equipment can be replaced with an inert gas and the oxygen concentration can be maintained at less than 3% all the time.

Moreover, as a structure of the recovery chamber of the spray-dryer equipment, in order to dry up the droplets sprayed by the rotary-disk instantaneously, a spray nozzle is provided at an upper portion of the rotary-disk in order to spray the pre-heated inert gas. An exhaustion opening is also provided at the bottom portion of the recovery chamber in order to exhaust the sprayed gas. It is preferable to heat and keep said spray nozzle at a constant temperature of 60~150° C., which is about the same as the pre-heated inert gas temperature, by a heater being installed at the external portion of the equipment, so that the pre-heated inert gas will not be cooled.

Namely, once the temperature of the pre-heated inert gas drops, the sprayed droplets will not be able to be dried up within a short period of time, so that the supplying amount of the slurry is needed to be reduced, resulting in a reduction of the production efficiency.

Furthermore, when the granulated powders having a relatively large particle size are produced, the revolution of the rotary-disk is required to reduce to accommodate the large particle size powders. At this moment, if the pre-heated inert gas temperature drops, the sprayed droplets cannot be dried up sufficiently, so that it is needed to decrease the supplying amount of the slurry. As a result, the production efficiency will decrease to a great extent due to treating the relatively large particle size powders.

Accordingly, in order to feed the pre-heated inert gas at a constant pre-determined temperature into the recovery chamber, it is preferable to keep the spray-nozzle temperature at a temperature range of 60~150° C.; more specifically about 100° C.

Moreover, since the temperature difference between the spray-nozzle and the exhaust opening is small, there is a tendency to reduce the production efficiency, so that it is preferable to keep the exhaust opening temperature less than 50° C., more preferably less than 40° C., but more specifically it is desired to keep it at room temperature.

As for the inert gas, it is preferable to use nitrogen or argon gas, and the pre-heating temperature would be in a temperature range of 60~150° C.

The particle size of the thus obtained granulated powders can be controlled according to the supply amount of the slurry into the sprey-dryer apparatus and the revolution number of said rotary-disk. For example, if the average particle size of the rare-earth system alloy powders is less than 10 $\mu$m, the flowability of the granulated powders is not improved. On the other hand, if the particle size exceeds 400 $\mu$m, the compaction of the powders into the dia cavity for forming will be reduced, so that the density of the formed product will also be reduced. Moreover, the resultant density of the final sintered product after the sintering process will also be reduced. Hence it is preferable to use the powders having a particle size varying in a range of 10~400 $\mu$m; more specifically in a range of 40~200 $\mu$m.

Although the primary (raw) particle of fine powders is anisotropic, the granulated powders according to the present invention is isotropic. Hence, when these granulated powders are subjected to forming without applying the magnetic field, the final product will show an isotropic nature. On the other hand, if the granulated powders are formed under the applied magnetic field, the granulated powders are broken into the original primary particle under the actions of compressive force and the magnetic field, leading that said primary particle will be orientated under the applied magnetic field, and exhibits anisotropy.

Furthermore, since the granulated powders according to the present invention are coated with the binder, said powders are hardly oxidized even after being exposed to the atmospheric environment. Therefore, the operational efficiency in the forming process will be improved, which is one of the advantages associated with the present invention.

If the granulated powders are furthermore sieved to control the particle size without any undercut and overcut sizes, the granulated powders which show the extremely good flowability can be produced.

The flowability can be further enhanced by adding a small amount of a lubricant agent to the granulated powders; said lubricants will include stearic acid zinc, stearic acid magnesium, stearic acid calcium, stearic acid aluminum, polyethylene glycol, aliphatic ester, or boric acid ester compounds.

If the aliphatic ester or boric acid ester compound is used as a lubricant, individual particles of the granulated powders can be easily orientated during the press-forming process under the applied magnetic field.

Namely, the surface area of the individual powder is coated with the binder, but without being treated with said lubricant, the sliding effect of the binder is not sufficient due to the intra-particle binding force. Hence the orientation of the granulated powders generated by the applied magnetic field is poor, and the magnetic properties (particularly, the residual magnetic flux, Br) of the permanent magnets produced using said powders will be reduced. However, when the lubricant is applied to the granulated powders, the slidability between particles can be improved, so that the resultant Br (residual magnetic flux) will also be improved. The main reason why the aliphatic ester or boric acid ester compound is selected is based on the facts that the improved slidability can be achieved with even a small addition amount thereof, residual carbon content in the final sintered product will be small, and, therefore, no adverse effects are on the magnetic properties.

It is preferable to choose the aliphatic ester having $C_{12}$~$C_{30}$ saturated (or unsaturated) aliphatic acid radicals, including mono-carbonxylic acid ester groups such as lauric acid methyl, lauric acid ethylene, palmitic acid methyl, stearic acid methyl, or oleic acid methyl, or poly-valent carboxylic acid ester such as ethylene glycol di-stearate.

The aliphatic acid with less than $C_{12}$ has a poor lubricancy, while the aliphatic acid with more than $C_{30}$ is not easily commercially available.

The boric acid ester system compounds used in the present invention refers to the boric acid tri-ester type compounds which is obtained by reacting the boric acid (including ortho-boric acid $H_5BO_3$ and meta-boric acid $HBO_2$) or boric acid anhydride ($B_2O_3$) with one or more than two types of mono- or poly-valent alcohols to produce esters.

As for the mono- or poly-valent alcohols used to produce the esters from the boric acid or boric acid anhydride, these are the following compounds available;

(a) uni-valent alcohol with the general formula: $R_1$—OH,
(b) diol with the following formula,
(c) glycerine or substituted glycerine, and their mono-eater or di-ester, and
(d) poly-valent alcohol besides the above (b) and (c), or their ester or alkylene oxide additives.

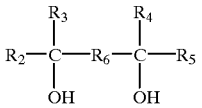

In the above general formula, $R_1$ is saturated or unsaturated radicals of aliphatic acid, aromatic or heterocyclic with carbons 3~22, $R_2$,$R_3$,$R_4$,$R_5$ (either one of these could be identical or different from each other) is H or saturated or unsaturated uni-valent organic radical of aliphatic acid or aromatic with carbons 1~15, and $R_6$ refers to a single-binding, —O—, —S—, —$SO_2$—, —CO—, or saturated or unsaturated organic di-valent radicals of aliphatic acid or aromatic having carbons 1~20.

As for a uni-valent alcohol mentioned in the above (a), there are n-butanol, isobutanol, n-bentanol, n-hexanol, n-hebutanol, n-octanol, 2-methylhexanol, nonanol, decanol, undecanol, dodecanol, tridecanol, tetradecanol, bentadecanol, hexadecanol, heptadecanol, octadecanol, or nonadecanol; preferably alcohol having carbons 3~18.

Besides these, the following alcohols can be used; namely, they include aliphatic unsaturated alcohol groups such as allyl alcohol, chlotyl alcohol, or propargyl alcohol, alicyclic alcohol group such as cyclobentanol or cyclohexanol, aromatic alcohol group such as benzylalcohol or cinnamylalcohol, or heterocyclic alcohol group including furfuryl alcohol.

Since uni-valent alcohol (such as methanol or ethanol) and boric acid ester with less than 2 carbons have a low boiling temperature and will easily volatilize right after the kneading with R—Fe—B alloy powders, they are, therefore, not preferable. On the other hand, uni-valent alcohol and boric acid ester with more than 22 carbons show a high melting point and poor uniform kneading capability. Moreover, there could be residual carbon after the sintering process.

As for di-valent alcohol (diol) mentioned in the above (b), there are α,ω-glycol groups including ethylene glycol, propylene glycol, 1,3-butane diol, 1,4-buthane diol, 1,5-pentane diol, 2-methyl-2,4-bentane diol, neobenthyl glycol, 1,6-hexan diol, 1,7-heptane diol, 1,8-octane diol, 1,9-nonan diol, or 1,10-decan diol, or symmetric α-glycol group including pinacol, hexan-1,2-diol, octane-1,2-diol or butanoyl-α-glycol, It is preferable to use diol having total carbons less than 10 and relatively low melting temperature, so that it is easy to mix and is economical.

Example for glycerine in the above (c) will be glycerine itself, and mono-ester or di-ester of glycerine and aliphatic acid with carbons 8~18. Typical ester of these types are lauric acid mono- or di-glycerite and oleic acid mono- or di-glycerite. Moreover, these substitute glycerine itself (for example, butane, 1,2,3-triol, 2-methyl propane-1,2,3-triol, pentane-2,3,4-triol, 2-methyl butane-1,2,3-triol, hexan-2,3,4-triol etc.) and mono-ester or di-ester of these substitute glycerine and aliphatic acid with carbons 8~18 can be utilized.

Examples for the poly-valent alcohol in the above list (d) are trimethyl propane, benta-erythrite, arabite, sorbite, sorbitane, mannite, or mannitane. Ester compounds (at least one OH radical is remained) such as mono-ester, di-ester, or tri-ester of these poly-valent alcohol and aliphatic acid with carbons 8~18, or ether-type additives in which 1~20 mol (preferably 4~18 mol) of alkylene oxide (for example, ethylene oxide or propylene oxide) is added to the aforementioned poly-valent alcohols which can be used.

The ester reaction of the boric acid or boric acid anhydride with the above listed alcohols can easily progress only by heating these reacting substances at the same time. The reaction temperature depends on the type of alcohol, it normally reacts under a temperature range of 100~180° C. It is preferable to progress the reaction under a stoichiometrical condition. The normal state of the obtained boric acid ester is either liquid or solid.

The addition amount of the aliphatic acid ester or boric acid ester will preferably be in a range of 0.01~2.0 wt %; more specifically 0.1~1.0 wt %. If the addition amount is less than 0.01 wt %, the sufficient coating on the granulated alloy powders can not be accomplished, so that the orientation effect under the forming process with the applied magnetic field cannot be obtained. On the other hand, if the amount exceeds 2.0 wt %, the residual carbon in the sintered product increases to deteriorate the magnetic properties.

When the above aliphatic acid ester or boric acid ester compound is added as a lubricant to produce the granulated powders, it is preferable to apply the pulse magnetic field with more than 10 kOe for more than one time prior to the forming process.

Normally, when the alloy powders are press-formed to produce an anisotropic magnet, the press process is conducted under a static magnetic field of 8~15 kOe, in order to orientation the primary particle. However, by forming the granulated powders according to the present invention, since the powders are not sufficiently orientated under the above mentioned static magnetic field due to the intra-particle binding force caused by the applied binder, it is rather preferable to press-form after applying the pulse magnetic field for more than one time prior to press-forming. With this method, although the magnetic field is also applied during the pressing, the manner of applying the magnetic field during the press-forming can be either the static magnetic field or repeated pulse magnetic field.

It is preferable to set the strength of the applied magnetic field with more than 10 kOe. When the pulse magnetic field is continuously applied even during the press-forming process, it is preferable to apply more than three (3) times of said pulse including the pulsation prior to the forming in order to produce the high orientation. The press pressure can be in the range of 0.3~2 ton/$cm^2$.

With not only for the granulated powders which is added and kneaded with the aliphatic acid ester or boric acid ester as a lubricant, but also the granulated powders produced by the present invention, the flowability of the powders will be improved by increasing the amount of the addition of the binder. However, on the other hand, the intra-primary particle binding strength will also become higher, resulting in that the granulated particles as a secondary powder will become harder. Since the secondary particles are magnetically isotropic, the sintered product having good magnetic properties cannot be produced if the strongly binded particles are not broken under the compressive force of the press or the applied magnetic field in order to orientation the C-axis of the primary particle.

Accordingly, in order to obtain the sintered body having excellent magnetic properties under addition of the binder with a relatively larger amount of 0.3~0.5wt %, it is preferable to conduct the press-forming process under the applied magnetic field more than 15 kOe. However, it would be difficult to generate a magnetic field higher than 15 kOe from the standpoint of mass-production level.

Hence, in the present invention, after the granulated powders are subjected to the applied magnetic field with more than 15 kOe instantaneously during the press-forming to have a magnetic orientation, the powders are press-formed under a static magnetic field of 8~15 kOe or pulse magnetic field with more than 15 kOe to have improved orientation. As a result, this method can improve the orientation furthermore and is evaluated to be the most suitable method for the mass-production.

After compacting the granulated powders into dia cavity, it is preferable to apply the pulse magnetic field with more than 15 kOe for more than one time. If the magnetic strength is less than 15 kOe, the broken particle out of the granulated powders cannot be sufficiently arranged along the C-axis, so that a great improvement in the residual magnetic flux of the final sintered product cannot be expected. The preferable strength of the pulse magnetic field is in a range of 15 kOe~40 kOe.

Unless the pulse magnetic field is applied more than one time, the frequency of the pulse magnetic field is not necessary to define. By increasing the frequency of the applied pulse magnetic field, the crushing effect of the granulated powders can be enhanced. However, if the frequency is increased too much, the total production time will be prolonged, causing poor production efficiency.

From this standpoint, it is preferable to apply the pulse magnetic field between 1 to 5 times. As for the pattern of the applied pulse magnetic field, it can be a single pulse, or a duplex pattern by which the static pulse magnetic field with 8 kOe~15 kOe is superimposed by the pulse magnetic field.

As has been described in the above, after the granulated powders are placed into dia cavity, the granulated powders are crushed down to the primary particle under the applied pulse magnetic field, followed by the compression-forming under the static and/or pulse magnetic field. For the static magnetic field, it is preferable to use the magnetic strength in a range of 8~15 kOe. Furthermore, Moreover, in order to enhance the orientation characteristics of the primary particle during the compression forming process, the pulse magnetic field which is more than 15 kOe used for the pre-crushing of the granulated powders can be applicable.

As for the pattern of the applied magnetic field during the compression forming process, any one of the following patterns can be utilized; namely, they will include a single static magnetic field, a single pulse magnetic field, a duplex pattern in which the static pattern is superimposed by the pulse pattern, or an alternative applying the static and pulse pattern.

Furthermore, in the present invention, the granulated powders obtained through the above mentioned processes are compacted into the desired shape of dia cavity, followed by the press-forming process under the pressurized punch. However, prior to said press-forming process, the granulated powders are subjected to a vibrational movement by applying the ultrasonic vibration on the dia cavity and/or the punch, so that only the granulated powders can be heated without heating the dia cavity due to the friction created between particles and/or the internal friction generated in the binder resins. Hence, by the thus generated heat, the binder will be softened, resulting in that the lubricant property is improved and enhance the magnetic orientation characteristics. Overall, the density of the final formed product can be improved.

Although a slight temperature raise can be noticed on the dia cavity due to the heat-transfer from the heated granulated powders, this raised temperature cannot be high enough to melt down the binder resins. Therefore, it is not required to cool dia cavity before the subsequent forming process. Besides, the usage of the rotary press is not required, so that said dia cavity is useful for forming under the applied magnetic field to produce the anisotropic magnets.

Moving on to discuss the ultrasonic vibration, the frequency of 10~40 kHz and the amplitude of 1~100 $\mu$m would be applicable. When the ultrasonic with a frequency less than 10 kHz or more than 40 kHz, or with the amplitude less than 1 $\mu$m is used, the time required for heating the granulated powders by the ultrasonic vibrational movement will be prolonged. On the other hand, if the amplitude of the used ultrasonic exceeds 100 $\mu$m, the temperature raise generated by these vibrational movement is too high, so that the magnetic properties of the obtained products will be deteriorated due to overheating. Hence, it is preferable to use the ultrasonic with the frequency of 15~35 kHz, and the amplitude of 5~50 $\mu$m.

The manner of applying the ultrasonic vibrational movement to the granulated powders can be performed by installing at least one ultrasonic horn either at an upper punch, lower punch or the metallic mold. Moreover, when a cylindrical body is required to be formed, a core—which is located at a center portion of the ring-shaped lower punch and has the shape of a cylindrical component which is provided at the inner diameter portion of the body—can be subjected to the ultrasonic vibration, during the forming process of the cylindrical magnets.

During the application of the ultrasonic vibration, it is recommended to set the compressive force that is applied to the fed granulated powders in the dia cavity to be less than 100 kg/cm$^2$. If the compressive force exceeds 100 kg/cm$^2$, the effective vibration will be constrained, so that the time required for the heating will be prolonged. Although the lower limit of the magnitude of the compressive force which is applied during the ultrasonic vibrational movement is not defined specifically, it is normally required to be set higher than 1 kg/cm$^2$ in order to transfer the ultrasonic vibrational energy effectively. The preferable range of the compressive force applied during the ultrasonic vibration is 5~50 kg/cm$^2$; more specifically a range from 10 to 30 kg/cm$^2$. Incidentally, prior to the ultrasonic vibration application, the granulated powders can be pre-compressed under the aforementioned range of forces.

The time for the applying the ultrasonic vibration should be longer than 0.5 seconds. If shorter than 0.5 seconds, the start-up of the desired oscillation condition will be so rapid that the control of the ultrasonic oscillation will be difficult, and this is not practical. Basically, the time for the application of the ultrasonic vibration is determined preferably to be long enough to soften the polymers included in the binder that is contained in the granulated powders. This duration depends on the frequency, amplitude, and type and compositions of binder contained in the granulated powders. Normally, it is preferable to set 0.5~10 seconds; more specifically 0.5~5 seconds.

After compressing for a short period of time under a force of less than 100 kg/cm$^2$ while applying the ultrasonic vibrational movement, the ultrasonic vibration will stop and the granulated powders inside the dia cavity will be further pressed. The magnitude of the compressive force should be high enough to produce a pressed mold that can withstand the handling taken place during the decarbonization and sintering processes. Although there is no particular limitation for said compressive force, it is preferable to set it at more than 100 kg/cm$^2$.

According to the present invention, the granulated powders will vibrate under the ultrasonic vibrational movement to increase the compaction degree of the powders. At the same time, since the binder resins will soften, the compacted body can be produced at a compressive force which is much lower than those used for the conventional press forming process. For example, it can be in a range of 100 kg/cm$^2$~3 ton/cm$^2$; more preferably it can be a range of 200 kg/cm$^2$~2 ton/cm$^2$ to obtain the pressed body with a sufficient strength.

In a case when the sintered magnet having a magnetic anisotropy is produced, using a dia cavity on which the magnetic coil is provided as a conventional type, a horizontal or vertical magnetic field will be applied to the granulated powders inside said dia cavity during the press-forming process to rotate the magnetic easy axes of the alloy powders to arrange it along the direction of magnetic field. It is preferable to set the strength of the magnetic field to be in a range of 10~20 kOe. It is preferable to apply the magnetic field also during the ultrasonic vibration. By applying the magnetic field to the granulated powders while being vibrated ultrasonically, the magnetized powders can be easily aligned along the direction of the magnetization, hence the orientation will be enhanced and the magnetic properties will be improved.

Powder Metallurgy Method

For the processes involved for producing the sintered permanent magnets using the granulated powders, according to the present invention; namely, they include forming, sintering, and heat-treatment, any type of prior art methods can be employed in the powder metallurgy techniques. In the following, a preferable example will be described.

Although the formation can be achieved by using a prior art forming method, it is most preferable to perform the formation under a compressive forming process, and the pressure can be in a range of 0.3~2.0 ton/cm$^2$. Moreover, the strength of the applied magnetic field is preferably in a range of 10~20 kOe.

Furthermore, if the surface of the dia cavity is lubricated with aliphatic acid ester or the like, the seizure can be prevented. If non-magnetic super-hard materials such as SiC, $Si_3N_4$ or other ceramics is used for the mold materials, the orientation characteristics can be further improved.

Prior to the sintering process, it is preferable to remove the binder (namely, de-binder treatment) either by heating in a vacuum (which is the generally operated method), or heating at a heating rate of 100~200° C./hr in hydrogen vapor flow and holding at 300~600° for 1~2 hours. By the de-binder treatment, almost all of carbon contained in the binder substances can be de-carbonized, resulting in an improved magnetic properties.

Since the alloy powders containing R-element are prone to an easy absorption of hydrogen, it is preferable to conduct the de-hydrogen treatment after the de-binder treatment in a hydrogen vapor flow. The de-hydrogen treatment is operated in a vacuum at a heating rate of 50~200° C./hr, followed by raising the temperature at a range of 500~800° C. for 1~2 hours to remove the absorbed hydrogen completely.

After said de-hydrogen treatment, it is preferable to increase the temperature continuously as required for the sintering process. A heating rate above 500° C. can be selected arbitrarily; for example, the heating rate of 100~300° C./hr is a known rate in the prior art employed for the sintering process.

Conditions for sintering as well as heat-treatments for the sintered products of the binder-removed and formed body can be chosen depending on the compositions of the alloy powders. For a case of producing R—Fe—B system magnets, the following conditions for the sintering as well as heat-treatments on the sintered body are preferable; namely, holding at 1000~1200° C. for 1~2 hours for sintering, and 450~800° C. for 1~8 hours for the aging treatment.

Furthermore, in order to suppress the chemical reaction of the R component contained in the R—Fe—B system alloy powders with the binder substance and organic solvent, instead of the single composition of R—Fe—B system alloy powder which is commonly used in the conventional powder metallurgy technology, the following principle dual-phase raw powders can be used to reduce the residual oxygen level in the sintered products; namely, they are (1) the first principle raw powder with an average particle size of 1~10 μm mainly consisting of $R_2Fe_{14}B$ phase, and (2) the second principle raw liquid-phase powder with an average particle size of 8~40 μm which is slightly larger than the first raw particle in order to suppress the reactivity with the organic substances as much as possible, said the second liquid-phase powders containing more rare-earth system is consisted of a intermetallic compound of Co or Fe containing $R_3Co$ phase and R element, and a fraction of $R_2(FeCo)_{14}B$ phase.

An operational function of the production method of rare-earth system sintered permanent magnets, according to the present invention, will be described referring to attached drawings. FIG. 1 is a partial view of the disk portion of the rotary-disk type sprey-dryer apparatus which is utilized in the present invention.

Said rotary-disk 1 shown in FIG. 1 is a pin-type rotary disk in which a plurality of non-magnetic pin 3 with a certain length is provided vertically on a peripheral portion with a pre-determined interval and a pair of disks 2,2 is fixed therebetween by a nut 4. Hence said pair of disk are held firmly with a certain distance from each other. A rotary shaft 5 is provided at the center of said rotary disk 1 and a side portion thereof is formed as a slurry supplying port.

The rotary disk 1 is provided horizontally and rotatably inside the chamber (not shown), which has a closed structure. At a certain location above the rotary disk 1, a nozzle for the inert gas is provided in order to spray downwardly, and a lower portion of said chamber serves as a recovery component of the granulated powders.

The slurry which is prepared by adding and kneading a certain type and amount of binder to magnetic powders is then supplied from the slurry stirring device to the sprey-dryer apparatus and the slurry will be sprayed under a centrifugal force of said rotary disk 1. The thus sprayed droplet will be dried immediately by a pre-heated inert gas flow and falls naturally at the bottom portion of the recovery component.

The granulated powders processed through the aforementioned processes is then formed; sintered and heat-treated, in order to obtain the rare-earth system sintered permanent magnets possessing a good dimensional accuracy, a unique configuration of small size, thin wall thickness and intricate shape, and excellent magnetic characteristics.

Several examples according to the present invention will be described in below.

Embodiment

EXAMPLE 1-1

Raw materials comprising of Nd 13.3 at. %, Pr 0.31 at. %, Dy 0.28 at. %, Co 3.4 at. %, B 6.5 at. %, balanced with Fe with an unavoidable impurity is melted in the high-induction furnace in Ar gas to obtain the button-shaped molten alloy. The obtained alloy is coarsely crushed down, followed by fine crushing with a jaw-crusher into an average particle size of 15 μm. Furthermore, the crushed powder is refined to have an average particle size of 3 μm by jet-milling.

To 100 wt % of the obtained rare-earth system alloy powders, a binder (which is equivalent to the bonder type (1), as described previously) consisting of water and polymer (with addition amount listed in Table 1-1 No. 1~10), and a plasticizer is mixed, followed by kneading at room temperature to form a slurry. Said slurry is then subjected to produce granulated powders by using a rotary-disk type sprey-dryer apparatus with nitrogen gas as an inert gas at an inlet temperature of 100° C. and an outlet temperature of 40° C.

The produced granulated powders is sieved to undercut (remove) particles smaller than #440 sieve size. Moreover, the granulated powders is also, sieved to overcut (remove) particles larger than #70 sieve size. The average particle size and yield percentage of the thus sieved granulated powders are listed in Table 1-2 No 1~10.

After the granulated powders are formed into a shape of 10 mm×15 mm×10 mm (thickness) by using a compression machine under the strength of a magnetic field of 15 kOe and pressure of 1 ton/cm$^2$, the powders were heated at 300° C. by a heating rate of 100° C./hr in hydrogen gas atmosphere to conduct the de-binder treatment. Subsequently, after the temperature increased up to 1100° C. and kept for 1 hour, said powders were sintered in vacuum. After the sintering process is completed, the temperature is cooled down to 800° C. at a speed of 7° C./min by introducing Ar gas, followed by holding at 550° C. for 2 hours at a cooling rate of 100° C./hr in order to obtain an aged sintered body with anisotropy.

Results on measured average particle size of granulated powders, flowability, dimension of the formed product, density, as well as residual oxygen, residual carbon level and magnetic properties of the sintered magnets are all listed in Table 1-2, and Table 1-3 No 1~10. No evidences of cracks, or deformation was observed on the final sintered magnets. The flowability was measured for the time required for 50 g of powder to fall down and pass through a funnel tube with an inner diameter of 5 mm.

EXAMPLE 1-2

Raw materials comprising of Sm 11.9 at. %, Cu 8.8 at. %, Fe 12.6 at. %, Zr 1.2 at. %, balanced by Co along with an unavoidable impurity is melted in the high induction furnace in an atmosphere of Ar gas to obtain the button-shaped molten alloy. The alloy was coarsely crushed, crushed further down to an average particle size of about 15 $\mu$m by a jaw crusher, followed by jet-milling to have an average particle size of 3 $\mu$m.

To 100 wt % of the obtained rare-earth system alloy powders, the binder consisted of polymers and water with an addition amount as listed in Table 1-1 No. 11 and a plasticizer are added to produce granulated powders under the same procedures as Example 1-1.

After sieving the thus obtained granulated powders with the sieve size #440 for undercut of finer particle size and #70 for overcut of coarser particle size. The resultant average particle size and the yield percentage from the sieve #440 to the sieve #70 are listed in Table 1-2 No. 11.

Using the compression machine, the granulated powders were pressed into a dimension of 10 mm×15 mm×10 mm (thickness) under an applied magnetic field of 15 kOe and pressure of 1 ton/cm$^2$. This forming process was followed by the de-binder treatment done in the hydrogen atmosphere by heating from room temperature up to 300 ° C. at a heating rate of 100° C./hr. The de-bindered granulated powders were then sintered in a vacuum at 1200° C. for 1 hour. After the completion of the sintering process, the sintered body was solution-treated at 1160° C., followed by a multiple-step aging by cooling from 800° C. to 400° C. while introducing Ar gas.

The measured average particle size of the granulated powders, the flowability of the granulated powders during the forming, dimension accuracy and density of the formed body, residual oxygen and carbon levels and magnetic properties of the final sintered magnets are listed in Table 1-2 No. 11 and Table 1-3 No. 11. The flowablity was measured under the same procedure done for Example 1-1.

Comparison 1-1

Alloy powders used for the Example 1-1 was subjected to fabricate the sintered permanent magnets under the same procedures as Example 1-1, but without a granulation treatment. The results of the measured properties as Example 1-1 are listed in Table 1-1 No. 12.

Comparison 1-2

The alloy powders used for Example 1-2 were formed under the same conditions of the magnetic field pressing done for the Example 1-2 without a granulation treatment. The formed body was then sintered in vacuum at 1200° C. for 1 hour, followed by the solution treatment at 1160° C. The solution treatment was then followed by the multiple-step aging by cooling from 800° C. to 400° C. while introducing Ar gas. Results obtained from various measurements done for Table 1-2 are listed in Table 1-2 No. 13 and Table 1-3 No. 13.

As clearly seen from Table 1-1, Table 1-2, and Table 1-3, the granulated powders exhibits an excellent flow ability by adding a binder consisting of at least more than one type of polymers and water and plasticizer if required to the rare-earth system alloy powders such as R—Fe—B system alloy powders or R—Co system alloy powders to make the kneaded powders into a slurry state, followed by granulation by using the spray-dryer equipment. By the subsequent press-forming process, de-binder treatment, sintering and aging heat-treatment make the compacted body made of granulated powders with an excellent flowability. As a result, the sintered permanent magnets having an improved dimensional accuracy, a unique configuration of small size, thin wall thickness as well as an intricate geometry, and enhanced magnetic properties which can be produced.

EXAMPLE 2-1

To a 100 wt % of the rare-earth system alloy powders, similarly to Example 1-1, the binder (which is equivalent to binder type (2), as mentioned previously) consisted of polymers and organic solvents with addition amounts as listed in Table 2-1 No. 14~19 and plasticizer are kneaded and kneaded to make it in a slurry state at room temperature. The granulation was done under the same conditions as that of Example 1-1. Furthermore, an anisotropic sintered body was fabricated under same conditions of forming, sintering and heat-treatment as done for Example 1-1.

The slurry concentration before the granulation, the flowability of the granulated powders during the forming, and the residual oxygen and carbon as well as magnetic properties of the sintered permanent magnets are measured, respectively. The obtained results are listed in Table 2-2 No. 14~19. No breaks, cracks and deformation were observed on the final sintered body.

EXAMPLE 2-2

Similar to the Example 1-2, the binder (which is equivalent to the binder type (2), as mentioned previously) comprising polymers and organic solvents with addition amounts as shown in Table 3-1 No. 20~25 and plasticizer are kneaded to a 100 wt % of the R—Co system rare-earth system alloy powders, and kneaded to make it into a slurry state at room temperature. After the granulation is done at the same conditions utilized for Example 1-2, the anisotropic sintered permanent magnets are fabricated after forming, sintering, and heat-treatment.

The slurry concentration prior to the granulation, the flowability of the granulated powders during the forming, and the residual oxygen and carbon levels as well as magnetic properties of the sintered permanent magnets are measured. The obtained results are listed in Table 3-1 No. 20~25. No breaks, cracks and deformation were observed on the sintered body.

As clearly seen from Table 2-1, Table 2-2, Table 3-1, and Table 3-2, by adding a binder consisting of at least more than one type of polymer and organic solvent and plasticizer if required to rare-earth system alloy powders such as R—Fe—B system alloy powder or R—Co system alloy powder and kneading the mixture to make it in a slurry state, followed by the granulation with spray-dryer equipment, the thus granulated powders show an excellent flowability. By further processing of press-forming, de-binder treatment, sintering, and aging heat-treatment, the continuous press formability can be improved due to said excellent flowability. Moreover, since the anhydride slurry is formed, the oxidation reaction of the alloy powders can be controlled to a great extent. Accordingly, sintered permanent magnets having a good dimension accuracy, a unique configuration of a small size, thin wall thickness and intricate geometry, as well as excellent magnetic properties can be produced.

EXAMPLE 3-1

Similar to the Example 1-1, the binder (which is equivalent to the binder type (2) and (3), as mentioned previously) consisted of polymers and organic solvent with addition amount listed in Table 4-1 No. 26~40 and Table 5-1 No. 26~40 is added to a 100 wt % of R—Fe—B system rare-earth alloy powders along with a lubricant. After kneading at room temperature, the granulation was done under the same conditions used for Example 1-1. Furthermore, the granulated powders are formed, sintered and heat-treated under the same conditions as for Example 1-1 in order to produce an anisotropic sintered body.

The average particle size of the obtained granulated powders are listed in Table 4-2 and Table 5-2. The flowability of the granulated powders during the forming and residual oxygen and carbon levels and magnetic properties of the sintered body are listed in Table 6 No. 26~40. The flowability was measured for the time required for 100 g of powder to naturally fall down inside the funnel tube with an inner diameter of 5 mm. After sintering, no cracks, breaks and deformation were noticed.

EXAMPLE 3-2

The binder (which is equivalent to the binder types (2) and (3), as described previously) consisted of polymers and organic solvent with addition amount listed in Table 7-1 No. 41~53 and Table 8-1 No. 41~53 is added to a 100 wt % of R—Co system rare-earth alloy powders along with a lubricant under a similar manner as Example 1-2. After kneading at room temperature, the powders are granulated by a similar way as that of Example 1-2. Furthermore, the granulated powders are formed, sintered and heat-treated under the same conditions done as Example 1-2 in order to fabricate an anisotropic sintered body.

The average particle size of the granulated powders are listed in Table 7-2 and Table 8-2. The flowability of the granulated powders during the forming and residual oxygen and carbon levels and magnetic properties of the sintered body are listed in Table 9 No. 41~53. The flowability was measured for the time required for 100 g of powder to naturally fall down inside the funnel tube with an inner diameter of 5 mm. After sintering, no cracks, breaks and deformation were noticed.

EXAMPLE 4-1

The binder (which is equivalent to the binder types (2), (3), and (4) as mentioned previously) consisted of polymers and organic solvent with addition amounts listed in Table 10-1 No. 54~69 and Table 11-1 No. 54~69 is added to a 100 wt % of R—Fe—B system rare-earth alloy powders along with a lubricant agent. After kneading at room temperature to make it into a slurry state, the granulation was conducted under the same conditions done for the Example 1-1. The granulated powders are formed, sintered and heat-treated under the same conditions for that of Example 1-1 to obtain the an anisotropic sintered body.

The average particle size of the granulated powders are listed in Table 10-2 and Table 11-2. The flowability of the granulated powders during the forming and residual oxygen and carbon levels and magnetic properties of the sintered body are listed in Table 12 No. 54~69. The flowability was measured for the time required for 100 g of powder to naturally fall down inside the funnel tube with an inner diameter of 5 mm. After sintering, no cracks, breaks and deformation were noticed.

EXAMPLE 4-2

Similar to the Example 1-2, the binder (which is equivalent to the binder types (2), (3), and (4), as described previously) consisted of the polymers and organic solvent with addition amounts listed in Table 13-1 No. 70~83 and Table 14-1 No. 70~83 is added to a 100 wt % of R—Co system rare-earth alloy powders along with a lubricant agent. After the room temperature kneading which is done to make it in a slurry state, the slurry was subjected to a granulation under the same conditions done for that of Example 1-2. The forming, sintering and heat-treatment were followed under the same conditions for Example 1-2 to produce an anisotropic sintered body.

The average particle size of the granulated powders are listed in Table 13-2 and Table 14-2. The flowability of the granulated powders during the forming and residual oxygen and carbon levels and magnetic properties of the sintered body are listed in Table 15 No. 70~83. The flowability was measured for the time required for 100 g of powder to naturally fall down inside the funnel tube with an inner diameter of 5 mm. After sintering, no cracks, breaks and deformation were noticed.

As clearly seen from Table 4-1, Table 4-2, and Table 15, by adding a binder comprising of polymers such as polyvinyl acetate and/or cellulose ether group and organic solvent such as alcohol, a mixture of alcohol and methyl chloride or a mixture of alcohol and water to rare-earth alloy powders such as R—Fe—B system or R—Co system powders in order to make the mixture into a slurry state, said slurry was granulated by spray-dryer equipment. The thus obtained granulated powders exhibit an excellent flowability, which shows a good continuous press-formability through the subsequent processes including forming, sintering and heat-treatment. The resultant final body shows good dimensional accuracy, a uniqueness in configuration such as a small size, thin wall thickness and intricate geometry and excellent magnetic properties.

EXAMPLE 5-1

A hydrophobic agent with addition amounts listed in Table 16-1 No. 84~93 is added and kneaded to 100 wt % of R—Fe—B system alloy powders, similar to Example 1-1. This hydrophobic treatment was followed by adding the binder (which is equivalent to the binder type (1) as described previously) consisted of polymers and water with addition amounts listed in Table 16-1 No. 84~93 along with a plasticizer in order to make the mixture into a slurry state at room temperature. The slurry was then granulated, followed by forming, sintering and heat-treating to produce an anisotropic sintered body.

The average particle size of the granulated powders, the flowability of the granulated powders during the forming and residual oxygen and carbon levels and magnetic properties of the sintered body are listed in Table 16-2 No. 84~93. The flowability was measured under the same conditions done for that of Example 1-1. After sintering, no breaks, cracks and deformation were noticed.

EXAMPLE 5-2

To 100 wt % of R—Co rare-earth alloy powders with the same condition as Example 1-2, a hydrophobic agent with addition amounts listed in Table 17-1 No. 94~103 is added and kneaded. This hydrophobic treatment was followed by adding the binder (which is equivalent to the binder type (1) listed previously) consisted of polymers and water with addition amounts listed in Table 17-1 No. 94~103 along with a plasticizer to a 100 wt % of said alloy powders, followed by room temperature kneading to make the mixture into a slurry state. The slurry was then granulated under the same conditions for that of Example 1-2. The forming, sintering and heat-treatment were performed under the same conditions for Example 1-2 in order to fabricate the anisotropic sintered product.

The average particle size of the granulated powders, the flowability of the granulated powders during the forming and residual oxygen and carbon levels and magnetic properties of the sintered body are listed in Table 17-2 No. 94~103. The flowability was measured under the same conditions done for Example. 1-2. After sintering, no breaks, cracks and deformation were noticed.

As seen clearly from Tables 16-1, 16-2, 17-1, and 17-2, by coating the hydrophobic compounds on the surface areas of rare-earth alloy powders such as R—Fe—B system or R—Co system powders, making said mixture into a slurry state by further adding the binder comprising of at least more than one type of polymers and water, and granulating the slurry, which the granulated powders show good flowability. During the press-forming, de-binder treating, sintering and aging treatment, since the surface areas are hydrophobically treated/coated, the oxidation reaction can be suppressed taking place between the surface areas of alloy powders and water component involved in the binder, resulting in that the residual oxygen and carbon levels in the sintered body can be reduced to a great extent.

EXAMPLE 6-1

The raw material consisting of Nd 14.03 at. %, Pr 0.15 at. %, Dy 0.61 at. %, Co 2.81 at. %, B 6.14 at. %, balanced by Fe with unavoidable impurities is melted in a high induction furnace in an Ar gas atmosphere in order to obtain a button-shaped molten alloy. The alloy was then crushed into an average particle size of 15 $\mu$m by the jaw crusher, followed by a further crushing down to an average particle size of 3 $\mu$m by a jet mill machine.

To a 100 wt % of the thus obtained rare-earth alloy powders, a binder (A,B) consisted of polymers and water with addition amounts listed in Table 18 along with the lubricant agent is added and kneaded in order to make the mixture into a slurry state. The slurry was then granulated with sprey-dryer apparatus under the following conditions; namely, the inert gas was nitrogen, the inlet temperature for the pre-heated air flow was 10° C., and the outlet temperature was 40° C.

The granulated powders were then sieved to undercut finer particles with a sieve #350 and overcut coarser particles with a sieve #70. The average particle size (of, namely, between –#350 and +#70) of the granulated powders No 104 and 105 is listed in Table 1. The yield percentage in a range of #350~#70 was 90%.

Equi-mol amount of oleic acid mono-glycerine, n-butanol and boric acid are condensation-reacted to the above obtained granulated powders. As a typical example as shown in the below, 0.2 wt % of the lubricant which is prepared by diluting the boric acid ester compounds by two-fold with n-dodecane is sprayed to a 100 wt % of the granulated powders. By dry-mixing in the mixer-stirrer at room temperature, said lubricant is uniformly distributed over the granulated powders. At this moment, the stirring was preformed at a low speed for a relatively short period of time in order not to crush the granulated powders. The thus treated lubricant-mixed granulated powders are referred to No. 106, 107, 108, and 109.

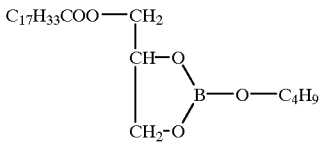

In the next step, the granulated powders were press-formed in the magnetic field under a pressure of 1.3 ton/cm$^2$. Samples No. 104 through 107 were formed under a static magnetic field with the magnetic strength of 10 kOe; while samples No 108 and 109 were press-formed under a pulse magnetic field with strength of 40 kOe for three times (one for prior to the forming and two times during the forming).

The lubricant agent for the dia cavity was myristic acid methyl. The shape of the formed body was a ring with a dimension of $\phi$25 mm×$\phi$18 mm×10.0 mm (wall thickness).

The above formed body is then subjected to the de-binder treatment in hydrogen gas atmosphere during heating from room temperature to 300° C. at a heating rate of 100° C./hr. The subsequent sintering was performed at 1100° C. for 4 hours in a vacuum. After the sintering, the furnace temperature was reduced to 800° C. by introducing Ar gas by a cooling rate of 7° C./min, followed by further cooling to 550° C. with a cooling rate of 100° C. and the sintered body was kept at 550° C. for 2 hours to fabricate anisotropic sintered products.

The flowability of the granulated powders during the forming, the dimensional accuracy and density of the formed body and the residual oxygen and carbon levels and magnetic properties of the sintered body are listed in Tables 19-1 and 19-2. The flowablity was measured for the time required for the 100 g of raw powder to naturally fall down in the funnel tube with an inner diameter of 8 mm. No breaks, cracks and deformation were observed in the sintered bodies.

As seen clearly from Tables 19-1 and 19-2, the orientation is enhanced by applying the internal lubricant between the granulated powders, so that the magnetic properties such as Br and (BH)max are improved. Moreover, the magnetic property is furthermore improved by applying the pulse magnetic field.

As a comparison example, powders with a particle size of 3 μm which is the same as that of Example 6-1 are, without granulation, subjected to magnetic pressing under a static magnetic field of 10 kOe to produce a ring-shape sample with a dimension of ϕ25 mm×ϕ18 mm×10.0 mm (thickness) under a pressure of 1.3 ton/cm$^2$. A lubricant agent for the dia cavity was aliphatic acid ester, which is the same type used for the present invention.

The above procedure was followed by sintering at 1100° C. for 4 hours in a vacuum. After the sintering was completed, the furnace temperature was reduced to 800° C. by introducing Ar gas by a cooling rate of 7° C./min. The temperature was further cooled down to 550° C. under a cooling rate of 100° C./h and the sample No. 110 was aged at 550° C. for 2 hours.

The flowability of the sample No. 110 during the forming and various properties of the formed body are listed in Table 19 as a conventional example. It was found that the ungranulated powder No. 110 showed poor flowability, and a large scatter in dimensional accuracy of the formed body.

Although the samples No. 104 and 105, which are not coated by a lubricant agent, showed a good flowability and less scatter in dimensional accuracy, the orientation was slightly poor, resulting in a small value in Br and (BH)max. On the other hand, samples No. 106 through 109 according to the present invention exhibit an improved flowability, enhanced orientation and excellent magnetic characteristics.

EXAMPLE 6-2

With respect to a 100 wt % of R—Co system alloy powders similar to that of Example 1-2, a binder consisted of polymers and water with addition amounts listed in Table 18 A was added along with the lubricant agent to make the mixture into a slurry state, followed by granulation under the same conditions done for Example 1-2.

The obtained granulated powders were subjected to sieving to under cut the finer particles with a sieve #350 and to overcut the coarser particles with a sieve #70. The sample No. 111 with an average particle size listed in Table 20 is obtained. The yield percentage between #350 and #70 was 86%.

The 0.2 wt. % of a lubricant which is prepared by diluting the boric acid ester which was used for Example 6-1 into two-fold with n-dodecane was spray-added to a 100 wt % of the granulated powders. By dry-mixing at room temperature in the mixer-stirrer, the lubricant is uniformly distributed between granulated powder particles. The stirring speed was at a low setting and the duration was short in order as not to crush the granulated powders. The thus prepared lubricant-mixed granulated powders are referred to in No 112 and 113.

By using the magnetic field press, No. 111 was pressed under a pressure of 1.3 ton/cm$^2$ with a static magnetic strength of 10 kOe, while samples Nos. 112 and 113 were pressed under a static magnetic field press with 10 kOe and pulse magnetic field press with 10 kOe for three times (once before the forming and twice during the forming).

The lubricant agent for the dia cavity was aliphatic acid ester. The press pressure was 1.3 ton/cm$^2$. The shape of the final body was a ring-shape with a dimension of ϕ25 mm×ϕ18 mm×10.0 mm (thickness).

The above formed body was then subjected to a de-binder treatment at 300° C. in a hydrogen atmosphere under a heating rate of 100° C./h. The de-binder treatment was followed by a sintering process which was conducted at 1200° C. for 1 hour in a vacuum. After the completion of the sintering, the sintered body was solution-treated at 1160° C. and was multiple-step aged from 800° C. to 400° C. by introducing Ar gas.

The flowability of the granulated powders during the forming, the dimensional accuracy and density of the formed body, and residual oxygen and carbon levels as well as magnetic properties of the sintered product are listed in Tables 20-1 and 20-2. The flowability was measured for the time required for 100 g of raw powders to naturally fall down inside the funnel tube with an inner diameter of 8 mm. It was found to have no breaks, cracks and deformation on the sintered products.

As seen clearly from Tables 20-1 and 20-2, the orientation is improved by applying the internal lubricant between granulated powders, so that magnetic properties including Br and (BH)max are also improved. Moreover, the magnetic properties are furthermore enhanced by applying the pulse magnetic field.

For a comparison example, using the same powder (with 3 μm average particle size) as used for the Example 6-2, the granulation was done, followed by pressing by a magnetic field press machine with a magnetic strength of 10 kOe under a pressure of 1 ton/cm$^2$ in order to fabricate a sample with a dimension of 10 mm×15 mm×10 mm (thickness). The pressed body was then sintered at 1200° C. for 1 hour in a vacuum. After the sintering was completed, the same procedure was applied for the multiple-step aging of the sintered product.

The flowability of the granulated powders during the forming, dimensional accuracy and density of the formed body and the residual oxygen and carbon levels as well as magnetic properties (of sample No. 114) are listed in Table 20-2. A conventional example for sample No. 114 in terms of the flowability as well as other characteristics are listed in Table 20-1. It was found that ungranulated powders No. 114 showed a poor flowability and large scatter in dimensional accuracy.

Although the granulated powders No. 111, to which the lubricant agent was not applied, showed good flowability and small scatter in dimensional accuracy, the orientation was slightly lower, resulting in lower values in Br and (BH)max. On the other hand, sample Nos.112 and 113 according to the present invention showed improved flowability and excellent magnetic properties.

EXAMPLE 6-3

A similar granulation was performed as that of Example 6-1 except that (1) five different binders (C~G) as listed in Table 21-1 were used instead of those listed in Table 18 for the Example 6-1. After the under sieving and overcut sieving, granulated powders Nos.115~119 were produced. The average particle size and yield percentage are also listed in Table 21-2.

Polymers with average molecular weight 500,000 for a polyethylene oxide, those with average molecular weight 30,000 for a polyvinyl acetal, those with acetal radical 10 mol %, acetyl radical 5 mol. %, and hydroxyl radial 85 mol.%, those with average molecular weight 10,000 for polyacryl acid and those with average molecular weight 20,000 for polyacryl acid ammonium are employed.

For the subsequent step, after kneading the boric acid ester which was used for the Example 6-1, the lubricant-mixed granulated powders Nos.120~129 were prepared. Using these granulated powders Nos.115~129, the magnetic field press was carried out. For powders Nos. 115~119,120, 122,124,126, and 128, the press was performed while applying the static magnetic field with the strength of 10 kOe; while powders Nos.121,123,125,127, and 129 were subjected to a prior application of the pulse magnetic field with 40 kOe before the press-forming, followed by a static magnetic field with 10 kOe during the press-forming.

Similar to Example 6-1, the pressed body was sintered and aged in order to fabricate the sintered magnets. The experimental data is listed in Tables 22-1, 22-2, 23-1, and 23-2, respectively. With the obtained sintered bodies, no breaks, cracks and deformation were found.

From Tables 22-1, 22-2, 23-1, and 23-2 clearly, it was found that, regardless of the type of binder for the granulation, the orientation was improved due to the internal lubrication between granulated powder particles in a similar manner as that of Examples 6-1 and 6-2, so that the magnetic properties such as Br and (BH)max are enhanced. Moreover, by applying the pulse magnetic field prior to the press-forming process, the magnetic properties are further improved.

EXAMPLE 7-1

In a similar manner as that of Example 1-1, the binder (which is equivalent to the binder type (1) as described previously) consisted of polymers and water with addition amounts listed in Table 24-1 and Table 24-2 No.a~g was added along with additives to a 100 wt % of the rare-earth alloy powders in order to make the mixture into a slurry state, followed by granulation under the same conditions done for Example 1-1.

After feeding the granulated powders into the metallic mold, the pulse magnetic field with 30 kOe and a static magnetic field with 10 kOe were applied to the granulated powders. This was followed by press-forming under a pressure of 1 ton/cm$^2$ in order to fabricate a sample with a dimension of 10 mm×15 mm×10 mm (thickness). After the completion of the press-forming, the pressed body was then sintered under the same conditions as that of Example 1-1 to obtain the anisotropic sintered body.

The average particle size and flowability are listed in Table 24-2. The dimensional accuracy and density of the press-formed body and the residual oxygen and carbon as well as magnetic properties of the sintered body are listed in Table 25-1 No. 130~139 and Table 25-2 No. 130~139, respectively. The flowability was measured for the time required for 50 g of raw powder to naturally fall down inside the funnel tube with an inner diameter of 5 mm.

No breaks, cracks and deformation were observed on the sintered body.

EXAMPLE 7-2

Similar to the Example 1-1, the binder (which is equivalent to the binder type (1), as mentioned previously) consisted of polymers and water with addition amounts listed in Table 26-1 No.h~l along with the plasticizer is added to a 100 wt % of R—Fe—B alloy powders to make the mixture into a slurry state at room temperature. The slurry was then granulated under the same conditions as done in Example 1-1. The granulated powders were press-formed under the conditions listed in Table 27-1 under the pressure of 1 ton/cm$^2$ in order to fabricate the sample with dimensions of 10 mm×15 mm×10 mm (thickness), followed by a heat-treatment under the same conditions applied to Example 1-1 in order to obtain the sintered body.

The average particles size and flowability of the granulated powders are listed in Table 26-2; while the residual oxygen and carbon levels as well as magnetic properties of the sintered body are listed in Table 27-2 No. 140~153.

EXAMPLE 7-3

The binder (which is equivalent to the binder type (2) as described previously) consisted of polymers and organic solvent with addition amounts listed in Table 28-1 No.m~r along with a plasticizer is added to a 100 wt % of R—Fe—B system alloy powders in a similar manner as that of Example 1-1 in order to make the mixture into a slurry state at room temperature. Under a similar condition done in Example 1-1, the granulation was carried out. The granulated powders were press-formed under the conditions listed in Table 29-1 and under pressure of 1 ton/cm$^2$ in order to fabricate a sample having dimensions of 10 mm×15 mm×10 mm (thickness), followed by heat-treatment to produce anisotropic sintered bodies.

The average particle size and flowability of the granulated powders are listed in Table 28-2; while the residual oxygen and carbon levels as well as magnetic properties of the sintered products are listed in Table 29-1 No. 154~168.

EXAMPLE 7-4

Similar to Example 1-2, the binder consisted of polymers and organic solvent with addition amounts listed in Table 30-1 No.s~y along with the plasticizer is added to a 100 wt % of R—Co alloy powders to make the mixture into a slurry state at room temperature. Under the same conditions as that of Example 2-1, the granulation was carried out.

The granulated powders were then press-formed under conditions listed in Table 31-2 and under the pressure of 1 ton/cm$^2$ in order to obtain a sample with a dimension of 10 mm×15 mm×10 mm (thickness), followed by heat-treatment in order to fabricate the anisotropic sintered products.

The average particle size and flowability of the granulated powders are listed in Table 30-2. The levels of residual oxygen and carbon as well as magnetic properties of the sintered products are listed in Table 31-2 No. 169~178.

As seen clearly from Tables 24~31, the application of pulse magnetic field prior to press-forming crushes the granulated powders into primary powders effectively. By the resultant orientation and the subsequent press-forming process under the static and/or pulse magnetic field, a sufficient orientation along the C-axis of the primary particle after press-forming is accomplished, so that the granulated powders exits good flowability and excellent continuous press-formability, enhanced dimensional accuracy and excellent magnetic properties can be produced.

EXAMPLE 8-1

In a similar manner for that of Example 1-1, the binder (which is equivalent to the binder type (1) listed previously) consisted of the polymers and water with addition amounts listed in Table 32 No. 179~191 along with a plasticizer is added to a 100 wt % of R—Fe—B alloy powders to make the mixture into a slurry state at room temperature. Then the slurry was granulated under the same conditions for Example 1-1.

The granulated powders were then subjected to the undercut sieving for finer particles with a sieve #440 and overcut sieving for coarser particles with a sieve #70. The average particle sizes between #440 and #70 sieve sizes and the yield percentages are listed in Table 33.

Figure 2:
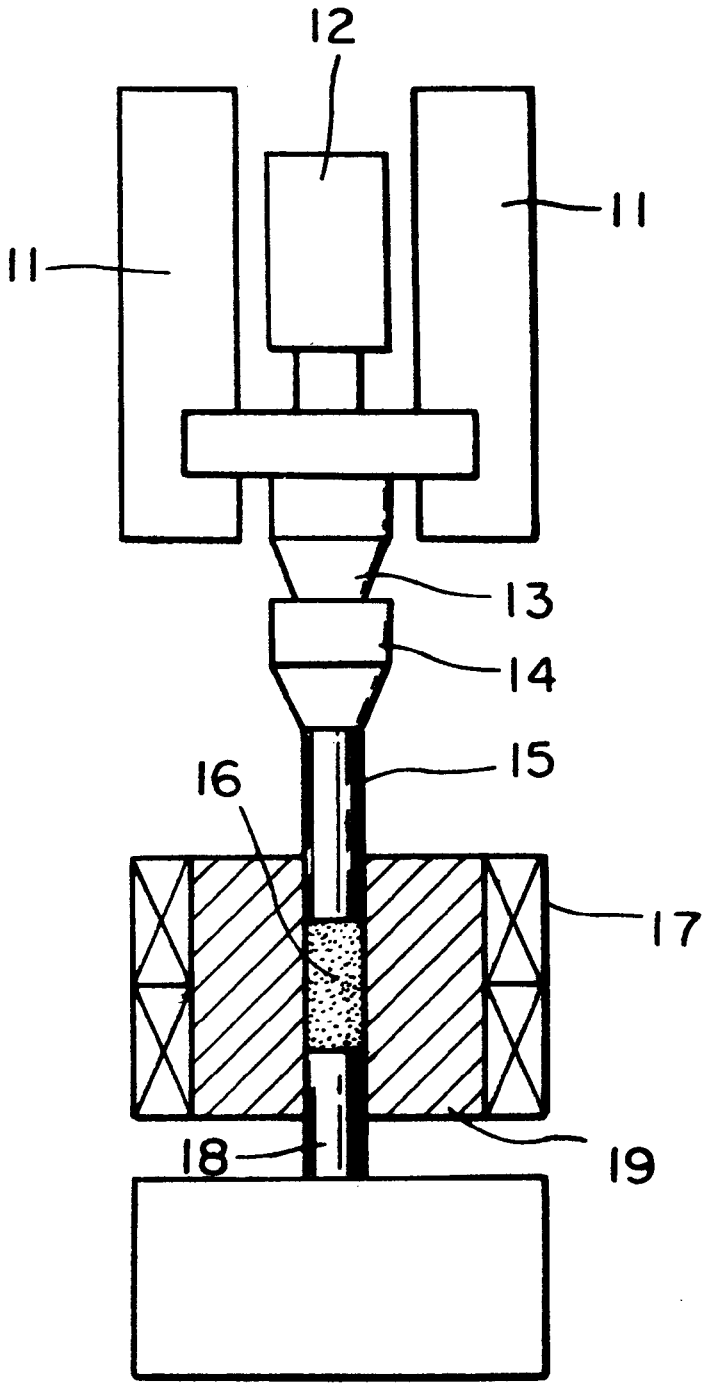
FIG. 2 is a simplified cross sectional view of the press machine in the magnetic field used for the application of the ultrasonic vibration according to the present invention.

The press-formability was evaluated by forming the sample with a dimension of 10 mm×15 mm×10 mm (thickness) by using a magnetic press forming machine, as seen in FIG. 2, in which an ultrasonic vibration is applied from the ultrasonic vibrator 12 to an upper punch 15 through a booster 13 and horn 14. A horizontal magnetic field is applied to raw granulated powders 16 inside the mold 19 from the magnetic coil 17 to the press-down direction.

After the raw granulated powders are fed into the dia cavity 19, the upper punch 15 moves downward while applying the ultrasonic wave at a certain frequency, oscillation time and amplitude as listed in Table 33 to the upper punch 15. The powders were pressed under the conditions listed in Table 33 in a magnetic field of 15 kOe. After the ultrasonic vibration stopped, while still keeping the horizontal vibration, immediately the press-forming was followed under the pressure listed in Table 34 (for the press-holding time of 3 seconds).

The thus pressed body was sintered and heat-treated to produce the anisotropic sintered product under similar conditions done for the Example 1-1.

The average particle size and flowability of the granulated powders are listed in Table 33. The dimensional accuracy and density of the press-formed body and levels of residual oxygen and carbon as well as magnetic properties are listed in Table 34-1 No. 179~191, and Table 34-2 No. 179~191, respectively.

The flowability was measured under the same conditions conducted for Example 1-1. No breaks, cracks and deformation were observed on the sintered products.

EXAMPLE 8-2

In a similar manner as that of Example 1-1, the binder (which is equivalent to the binder type (2) described previously) consisted of polymers and organic solvent with addition amounts listed in Table 35 along with a plasticizer is added to a 100 wt % of R—Fe—B alloy powders to make the mixture into a slurry state at room temperature, followed by granulation under the same conditions for Example 1-1.

The thus obtained granulated powders were press-formed, by using the compression magnetic field forming machine as seen in FIG. 2, under ultrasonic vibration conditions listed in Table 36-1 and with the magnetic field strength of 15 kOe to form a sample with a dimension of 10 mm×15 mm×10 mm (thickness) under a pressure of 1 ton/cm$^2$. The pressed body was then heat-treated under the same conditions as that of Example 1-1 to fabricate the anisotropic sintered product.

The flowability (measuring conditions are same as for the Example 1-1) of the granulated powders is listed in Table 35. The levels of residual oxygen and carbon as well as the magnetic properties of the sintered products are listed in Table 36-2 No. 192~203. The data listed in No. 200~203 is for comparison examples.

EXAMPLE 8-3

In a similar manner as that of Example 1-2, the binder consisted of the polymers and organic solvent with addition amounts listed in Table 37, No. 204~206 along with a plasticizer is added to a 100 wt % of R—Co alloy powders to make the mixture into a slurry state at room temperature, followed by granulation under the same conditions for Example 1-2.

The thus obtained granulated powders were press-formed, by using the compression magnetic field forming machine as seen in FIG. 2, under ultrasonic vibration conditions listed in Table 38-1 and with the magnetic field strength of 15 kOe to form a sample with a dimension of 10 mm×15 mm×10 mm (thickness) under a pressure of 1 ton/cm$^2$. The pressed body was then heat-treated under the same conditions for the Example 1-2 to fabricate the anisotropic sintered product.

The flowability (measuring conditions are the same as that of Example 1-1) of the granulated powders is listed in Table 37. The levels of residual oxygen and carbon as well as the magnetic properties of the sintered products are listed in Table 38-2 No. 204~206.

For the purpose of comparison, the anisotropic sintered magnet No. 207 was prepared under the same procedure as that of sample No. 204 except that the ultrasonic vibration was not applied. The residual oxygen and carbon and magnetic properties are also listed in Table 38-2.

EXAMPLE 8-4

In a similar manner as that of Example 1-2, the binder consisted of polymers and water with addition amounts listed in Table 39 No. 208~213 along with a plasticizer is added to a 100 wt % of R—Co alloy powders to make the mixture into a slurry state at room temperature. Then the slurry was granulated under the same conditions as done for Example 1-2.

The granulated powders were then subjected to the undercut sieving for finer particles with a sieve #440 and overcut sieving for coarser particles with a sieve #70. The average particle sizes were between #440 and #70 sieve sizes and the yield percentages are listed in Table 40.

The thus obtained granulated powders were then press-formed, by using the compression magnetic field forming machine as seen in FIG. 2, under ultrasonic vibration conditions listed in Table 40 and with the magnetic field strength of 15 kOe to form a sample with a dimension of 10 mm×15 mm×10 mm (thickness) under a pressure of 1 ton/cm$^2$. The pressed body was then heat-treated under the same conditions as done in Example 1-2 to fabricate the anisotropic sintered product.

The average particle size and flowability (measuring conditions are the same as that of Example 1-1) of the granulated powders are listed in Table 40. The dimensional accuracy and density of the formed body and levels of residual oxygen and carbon as well as the magnetic properties of the sintered products are listed in Table 41-1 No. 208~213 and Table 41-2 No. 208~213, respectively. Data for No. 212~213 are for comparison examples.

As seen clearly from Tables 32~41, by applying the ultrasonic vibrational movement to the punch prior to the forming, the granulated raw powders can be selectively heated without heating the mold extensively. As a result, if the pressure during the ultrasonic vibration, frequency and amplitude are set within the conditions defined by the present invention, the binder resin can be softened within 3 seconds under applied ultrasonic vibrational movement. Accordingly, good flowability can be exhanced and the sintered magnetic field, excellent continuous press-formability, good dimensional accuracy and excellent magnetic properties can be produced.

Moreover, as it is clear by comparison examples, if the ultrasonic vibration is not applied, or the pressure during the ultrasonic application is not applied, frequency is beyond the limitations defined by this invention, the effect of the ultrasonic is not sufficient, so that the residual magnetic flux of the sintered product is less than the preferred examples according to the present invention. Furthermore, when the amplitude of the ultrasonic vibration is selected beyond the preferable limit, the granulated powders will be rapidly heated, so that the chemically active rare-earth system will be oxidized with oxygen during the compression-forming process in air, resulting in that the level of residual oxygen will increase and the magnetic properties of the sintered body will be deteriorated.

TABLE 1-1

| No. | Binder (addition amount wt %) polymer (average molecular weight) | addition amount | plasticizer | addition amount | slurry conc. (%) |
|---|---|---|---|---|---|
| 1 | polyethylene oxide (500,000) | 0.3 | glycerine | 0.10 | 60 |
| 2 | polyvinyl acetal (30,000) | 0.3 | glycerine | 0.10 | 65 |
| 3 | polyacrylic acid (10,000) | 0.4 | diethylene glycol | 0.15 | 65 |
| 4 | polyacrylic acid ammonium (20,000) | 0.5 | ethylene glycol | 0.20 | 65 |
| 5 | carboxymethyl ammonium cellulose | 0.2 | glycerine | 0.14 | 55 |
| 6 | polyethylene oxide (500,000) | 0.15 | glycerine | 0.10 | 65 |
| | polyvinyl acetal (30,000) | 0.15 | | | |
| 7 | polyethylene oxide (500,000) | 0.15 | diethylene glycol | 0.10 | 65 |
| | polyacrylic acid (10,000) | 0.15 | | | |

TABLE 1-1-continued

| No. | Binder (addition amount wt %) polymer (average molecular weight) | addition amount | plasticizer | addition amount | slurry conc. (%) |
|---|---|---|---|---|---|
| 8 | polyethylene oxide (500,000) | 0.20 | glycerine | 0.02 | 65 |
| | polyacrylic acid ammonium (20,000) | 0.20 | | | |
| 9 | polyethylene oxide (500,000) | 0.15 | glycerine | 0.10 | 60 |
| | carboxymethyl ammonium cellulose | 0.15 | | | |
| 10 | polyethylene oxide (500,000) | 0.15 | glycerine | 0.10 | 65 |
| | polyvinyl alcohol (70,000) | 0.15 | | | |
| 11 | polyethylene oxide (500,000) | 0.3 | glycerine | 0.10 | 60 |
| 12 | — | — | — | — | — |
| 13 | — | — | — | — | — |

TABLE 1-2

| No. | average particle size (μm) | yield (%) | flowability (sec) | press-formability (n = 20) thickness (mm) | press-formability (n = 20) density (g/cm$^3$) | residual oxygen (ppm) | residual carbon (ppm) |
|---|---|---|---|---|---|---|---|
| 1 | 82 | 90 | 20 | max: 10.10 min: 10.01 | max: 4.45 min: 4.41 | 7200 | 700 |
| 2 | 65 | 78 | 25 | max: 10.14 min: 10.02 | max: 4.45 min: 4.39 | 7100 | 710 |
| 3 | 70 | 80 | 21 | max: 10.11 min: 10.03 | max: 4.45 min: 4.44 | 7100 | 740 |
| 4 | 67 | 90 | 17 | max: 10.16 min: 10.06 | max: 4.42 min: 4.38 | 7200 | 760 |
| 5 | 105 | 74 | 15 | max: 10.08 min: 10.00 | max: 4.47 min: 4.41 | 7200 | 690 |
| 6 | 88 | 79 | 22 | max: 10.11 min: 10.04 | max: 4.45 min: 4.40 | 7200 | 710 |
| 7 | 78 | 66 | 24 | max: 10.10 min: 10.05 | max: 4.45 min: 4.40 | 7100 | 700 |
| 8 | 70 | 82 | 25 | max: 10.12 min: 10.03 | max: 4.41 min: 4.38 | 7100 | 710 |
| 9 | 110 | 95 | 19 | max: 10.09 min: 10.05 | max: 4.45 min: 4.41 | 7100 | 720 |
| 10 | 85 | 89 | 24 | max: 10.11 min: 10.03 | max: 4.41 min: 4.38 | 7200 | 720 |
| 11 | 74 | 85 | 22 | max: 10.12 min: 10.01 | max: 4.46 min: 4.40 | 5500 | 530 |
| 12 | 3 | — | not flow | max: 10.20 min: 9.90 | max: 4.50 min: 4.30 | 7000 | 610 |
| 13 | 3 | — | not flow | max: 10.40 min: 9.40 | max: 4.61 min: 4.20 | 5100 | 400 |

TABLE 1-3

| No. | magnetic properties Br (kG) | iHc (kOe) | (BH)max (MGOe) |
|---|---|---|---|
| 1 | 12.4 | 14.2 | 36.1 |
| 2 | 12.4 | 14.3 | 36.7 |
| 3 | 12.3 | 14.3 | 36.2 |
| 4 | 12.4 | 14.1 | 36.3 |
| 5 | 12.5 | 14.2 | 36.7 |

TABLE 1-3-continued

| No. | magnetic properties Br (kG) | iHc (kOe) | (BH)max (MGOe) |
|---|---|---|---|
| 6 | 12.4 | 14.2 | 36.4 |
| 7 | 12.4 | 14.2 | 36.4 |
| 8 | 12.4 | 14.2 | 36.4 |
| 9 | 12.4 | 14.2 | 36.3 |
| 10 | 12.5 | 14.1 | 36.1 |
| 11 | 9.5 | 8.3 | 21.0 |
| 12 | 12.5 | 14.4 | 37.9 |
| 13 | 9.6 | 8.5 | 21.9 |

TABLE 2-1

| mark | No. | binder mixing composition polymer break strength (kgf/mm$^2$) | addition amount (wt %) | plasticizer | addition amount (wt %) | solvent | slurry conc. (%) |
|---|---|---|---|---|---|---|---|
| example | 14 | polymethyl methacrylate (0.65) | 0.5 | none | — | toluene | 60 |
| | 15 | polyvinyl acetal (1.0) | 0.3 | none | — | dioxane | 65 |
| | 16 | ethylene-methyl methacrylate co-polymer (0.55) | 0.4 | none | — | xylene/dicholoro-ethane (1/1) | 65 |
| | 17 | polycarbonate (3.5) | 0.1 | di-butyl phthalate | 0.02 | dicholoroethane | 65 |
| | 18 | polyvinyl butylate (4.0) | 0.3 | di-ocyl adipate | 0.10 | dioxane | 55 |
| | 19 | polyacrylate (4.5) | 0.3 | butylphtalyl butyl glycolate | 0.25 | benzene | 65 |

TABLE 2-2

| mark | No. | flowability (sec.) | residual oxygen (ppm) | residual carbon (ppm) | magnetic properties Br (kG) | iHc (kOe) | (BH)max (MGOe) |
|---|---|---|---|---|---|---|---|
| example | 14 | 21 | 5200 | 680 | 12.0 | 12.1 | 33.0 |
| | 15 | 18 | 5600 | 700 | 12.2 | 12.3 | 33.7 |
| | 16 | 19 | 5700 | 710 | 12.3 | 12.1 | 33.4 |
| | 17 | 18 | 5200 | 700 | 12.5 | 12.1 | 34.0 |
| | 18 | 17 | 5500 | 640 | 12.5 | 12.2 | 34.1 |
| | 19 | 19 | 5100 | 670 | 12.4 | 12.3 | 34.6 |

TABLE 3-1

| mark | No. | binder mixing composition polymer break strength (kgf/mm$^2$) | addition amount (wt %) | plasticizer | addition amount (wt %) | solvent | slurry conc. (%) |
|---|---|---|---|---|---|---|---|
| example | 20 | polymethyl methacrylate (0.65) | 0.5 | none | — | toluene | 60 |
| | 21 | polyvinyl acetal (1.0) | 0.3 | none | — | dioxane | 65 |
| | 22 | ethylene-methyl methacrylate co-polymer (0.55) | 0.4 | none | — | xylene/dichloro-ethane (1/1) | 65 |

TABLE 3-1-continued

| mark | No. | binder mixing composition: polymer break strength (kgf/mm$^2$) | addition amount (wt %) | plasticizer | addition amount (wt %) | solvent | slurry conc. (%) |
|---|---|---|---|---|---|---|---|
| | 23 | polycarbonate (3.5) | 0.1 | di-butyl phthalate | 0.02 | dicholorethane | 65 |
| | 24 | polyvinyl butylal (4.0) | 0.3 | di-octyl adipate | 0.10 | dioxane | 55 |
| | 25 | polyacrylate (4.5) | 0.3 | butylphtalyl butyl glycolate | 0.25 | benzene | 65 |

TABLE 3-2

| mark | No. | flowability (sec.) | residual oxygen (ppm) | residual carbon (ppm) | magnetic properties: Br (kG) | iHc (kOe) | (BH)max (MGOe) |
|---|---|---|---|---|---|---|---|
| example | 20 | 22 | 5100 | 720 | 9.3 | 8.1 | 20.4 |
| | 21 | 25 | 5200 | 700 | 9.4 | 7.9 | 20.9 |
| | 22 | 21 | 5100 | 710 | 9.4 | 8.5 | 20.8 |
| | 23 | 24 | 5300 | 530 | 9.6 | 7.8 | 21.2 |
| | 24 | 25 | 5500 | 620 | 9.5 | 8.1 | 21.4 |
| | 25 | 25 | 5500 | 680 | 9.6 | 8.6 | 21.6 |

TABLE 4-1

| No. | binder (added, wt %): poly-acetic vinyl | cellulose ether: type | cellulose ether: addition amount | solvent content (wt %): ethanol | solvent content (wt %): methanol | solvent content (wt %): methylene chloride |
|---|---|---|---|---|---|---|
| 26 | 0.10 | — | — | 35.0 | — | — |
| 27 | 0.30 | — | — | 35.0 | — | — |
| 28 | 0.50 | — | — | 35.0 | — | — |
| 29 | 0.30 | — | — | 35.0 | — | — |
| 30 | 0.30 | — | — | — | 35.0 | — |
| 31 | 0.30 | — | — | — | 35.0 | — |
| 32 | 0.15 | hydroxypropyl methyl cellulose | 0.10 | 35.0 | — | — |
| 33 | 0.10 | hydroxypropyl methyl cellulose | 0.15 | 35.0 | — | — |

TABLE 4-2

| No. | lubricant agent (added, wt %): type | lubricant agent (added, wt %): addition amount | average particle size (μm) |
|---|---|---|---|
| 26 | glycerine | 0 | 54 |
| | stearic acid | 0 | |
| 27 | glycerine | 0 | 63 |
| | stearic acid | 0 | |
| 28 | glycerine | 0 | 76 |
| | stearic acid | 0 | |
| 29 | glycerine | 0.05 | 69 |
| | stearic acid | 0.05 | |
| 30 | glycerine | 0 | 58 |
| | stearic acid | 0 | |
| 31 | glycerine | 0.05 | 64 |
| | stearic acid | 0.05 | |

TABLE 4-2-continued

| No. | lubricant agent (added, wt %): type | lubricant agent (added, wt %): addition amount | average particle size (μm) |
|---|---|---|---|
| 32 | glycerine | 0 | 63 |
| | stearic acid | 0 | |
| 33 | glycerine | 0 | 71 |
| | stearic acid | 0 | |

TABLE 5-1

| No. | binder (added, wt %): poly-acetic vinyl | cellulose ether: type | cellulose ether: addition amount | solvent content (wt %): ethanol | solvent content (wt %): meth-anol | solvent content (wt %): methylene chloride |
|---|---|---|---|---|---|---|
| 34 | 0.10 | hydroxypropyl methyl cellulose | 0.15 | — | 35.0 | — |
| 35 | 0.10 | hydroxypropyl methyl cellulose | 0.15 | 17.5 | — | 17.5 |
| 36 | 0.10 | hydroxypropyl methyl cellulose | 0.15 | — | 17.5 | 17.5 |
| 37 | 0.30 | hydroxypropyl methyl cellulose | — | 17.5 | — | 17.5 |
| 38 | 0.10 | hydroxypropyl methyl cellulose | 0.075 | 17.5 | — | 17.5 |
| | | carboxylmethyl cellulose ammonium | 0.075 | | | |
| 39 | 0.10 | hydroxypropyl methyl cellulose | 0.15 | 35.0 | — | — |
| 40 | 0.10 | hydroxypropyl methyl cellulose | 0.15 | 35.0 | — | — |

TABLE 5-2

| No. | lubricant agent (added, wt %): type | lubricant agent (added, wt %): addition amount | average particle size (μm) |
|---|---|---|---|
| 34 | glycerine | 0 | 74 |
| | stearic acid | 0 | |
| 35 | glycerine | 0 | 65 |
| | stearic acid | | |
| 36 | glycerine | 0 | 67 |
| | stearic acid | | |
| 37 | glycerine | 0 | 62 |
| | stearic acid | | |

TABLE 5-2-continued

| No. | lubricant agent (added, wt %) type | addition amount | average particle size (μm) |
|---|---|---|---|
| 38 | glycerine<br>stearic acid | 0 | 70 |
| 39 | glycerine<br>stearic acid | 0 | 73 |
| 40 | glycerine<br>stearic acid | 0 | 68 |

TABLE 6

| No. | flowability (sec.) | residual oxygen (ppm) | residual carbon (ppm) | magnetic properties Br (kG) | iHc (kOe) | (BH)max (MGOe) |
|---|---|---|---|---|---|---|
| 26 | 34 | 6400 | 550 | 12.4 | 12.1 | 36.3 |
| 27 | 24 | 6900 | 650 | 12.3 | 12.2 | 35.5 |
| 28 | 21 | 7500 | 760 | 12.0 | 13.5 | 33.4 |
| 29 | 29 | 7000 | 680 | 12.3 | 12.0 | 35.4 |
| 30 | 26 | 6800 | 660 | 12.3 | 12.3 | 35.5 |
| 31 | 30 | 7100 | 700 | 12.3 | 11.9 | 35.2 |
| 32 | 30 | 7000 | 660 | 12.5 | 11.6 | 36.6 |
| 33 | 27 | 7100 | 640 | 12.4 | 11.8 | 36.1 |
| 34 | 26 | 7100 | 640 | 12.4 | 12.2 | 36.2 |
| 35 | 29 | 7100 | 640 | 12.4 | 12.2 | 36.2 |
| 36 | 30 | 7200 | 620 | 12.4 | 11.9 | 36.0 |
| 37 | 29 | 7600 | 650 | 12.5 | 11.0 | 36.4 |
| 38 | 28 | 7500 | 630 | 12.5 | 11.8 | 36.5 |
| 39 | 28 | 7100 | 650 | 12.4 | 12.0 | 36.0 |
| 40 | 30 | 7200 | 660 | 12.4 | 12.1 | 36.0 |

TABLE 7-1

| No. | binder (added, wt %) poly-acetic vinyl | cellulose ether type | addition amount | solvent content (wt %) ethanol | metha-anol | methylene chloride |
|---|---|---|---|---|---|---|
| 41 | 0.30 | — | — | 35.0 | — | — |
| 42 | 0.30 | — | — | 35.0 | — | — |
| 43 | 0.30 | — | — | — | 35.0 | — |
| 44 | 0.30 | — | — | — | 35.0 | — |
| 45 | 0.10 | hydroxypropyl methyl cellulose | 0.15 | 35.0 | — | — |
| 46 | 0.10 | hydroxypropyl methyl cellulose | 0.15 | — | 35.0 | — |
| 47 | 0.10 | hydroxypropyl methyl cellulose | 0.15 | 35.0 | — | — |
| 48 | 0.10 | hydroxypropyl methyl cellulose | 0.15 | 17.5 | — | 17.5 |

TABLE 7-2

| No. | lubricant agent (added, wt %) type | addition amount | average particle size (μm) |
|---|---|---|---|
| 41 | glycerine<br>stearic acid | 0<br>0 | 47 |

TABLE 7-2-continued

| No. | lubricant agent (added, wt %) type | addition amount | average particle size (μm) |
|---|---|---|---|
| 42 | glycerine<br>stearic acid | 0.05<br>0.05 | 52 |
| 43 | glycerine<br>stearic acid | 0<br>0 | 43 |
| 44 | glycerine<br>stearic acid | 0.05<br>0.05 | 49 |
| 45 | glycerine<br>stearic acid | 0<br>0 | 63 |
| 46 | glycerine<br>stearic acid | 0<br>0 | 65 |
| 47 | glycerine<br>stearic acid | 0.05<br>0.05 | 58 |
| 48 | glycerine<br>stearic acid | 0 | 65 |

TABLE 8-1

| No. | binder (added, wt %) poly-acetic vinyl | cellulose ether type | addition amount | solvent content (wt %) ethanol | meth-anol | methylene chloride |
|---|---|---|---|---|---|---|
| 49 | 0.10 | hydroxypropyl methyl cellulose | 0.15 | — | 17.5 | 17.5 |
| 50 | 0.30 | hydroxypropyl methyl cellulose | — | 17.5 | — | 17.5 |
| 51 | 0.10 | hydroxypropyl methyl cellulose<br>carboxylmethyl cellulose ammonium | 0.075<br>0.075 | 17.5 | — | 17.5 |
| 52 | 0.10 | hydroxypropyl methyl cellulose | 0.15 | 35.0 | — | — |
| 53 | 0.10 | hydroxypropyl methyl cellulose | 0.15 | 35.0 | — | — |

TABLE 8-2

| No. | lubricant agent (added, wt %) type | addition amount | average particle size (μm) |
|---|---|---|---|
| 49 | glycerine<br>stearic acid | 0 | 67 |
| 50 | glycerine<br>stearic acid | 0 | 62 |
| 51 | glycerine<br>stearic acid | 0 | 70 |
| 52 | glycerine<br>stearic acid | 0 | 73 |
| 53 | glycerine<br>stearic acid | 0 | 68 |

TABLE 9

| No. | flowability (sec.) | residual oxygen (ppm) | residual carbon (ppm) | magnetic properties Br (kG) | iHc (kOe) | (BH)max (MGOe) |
|---|---|---|---|---|---|---|
| 41 | 27 | 5700 | 480 | 9.3 | 8.1 | 20.4 |
| 42 | 24 | 5900 | 510 | 9.4 | 7.8 | 20.8 |

TABLE 9-continued

| No. | flowability (sec.) | residual oxygen (ppm) | residual carbon (ppm) | magnetic properties Br (kG) | iHc (kOe) | (BH)max (MGOe) |
|---|---|---|---|---|---|---|
| 43 | 29 | 5800 | 470 | 9.3 | 8.2 | 20.5 |
| 44 | 27 | 5900 | 500 | 9.4 | 7.9 | 20.8 |
| 45 | 32 | 5400 | 460 | 9.4 | 7.8 | 20.8 |
| 46 | 30 | 5300 | 470 | 9.4 | 7.7 | 20.7 |
| 47 | 31 | 5700 | 270 | 9.5 | 7.3 | 21.1 |
| 48 | 27 | 5100 | 440 | 9.4 | 8.8 | 21.0 |
| 49 | 28 | 5200 | 420 | 9.4 | 8.5 | 20.8 |
| 50 | 27 | 5600 | 450 | 9.5 | 7.8 | 21.2 |
| 51 | 26 | 5500 | 430 | 9.5 | 8.3 | 21.3 |
| 52 | 26 | 5100 | 450 | 9.4 | 8.6 | 21.0 |
| 53 | 28 | 5200 | 460 | 9.4 | 8.7 | 21.1 |

TABLE 10-1

| | binder (added, wt %) | | solvent content (wt %) | | | |
|---|---|---|---|---|---|---|
| No. | type | addition amount | ethanol | methanol | methylene chloride | water |
| 54 | hydroxypropyl methyl cellulose | 0.20 | 35.0 | — | — | — |
| 55 | hydroxypropyl methyl cellulose | 0.20 | 35.0 | — | — | — |
| 56 | hydroxypropyl methyl cellulose | 0.20 | — | 17.5 | 17.5 | — |
| 57 | hydroxypropyl methyl cellulose | 0.20 | — | 17.5 | 17.5 | — |
| 58 | hydroxypropyl methyl cellulose | 0.30 | 25.0 | — | — | 10.0 |
| 59 | hydroxypropyl methyl cellulose | 0.30 | 17.5 | — | — | 17.5 |
| 60 | hydroxypropyl methyl cellulose | 0.30 | 17.5 | — | — | 17.5 |
| 61 | hydroxypropyl methyl cellulose | 0.30 | 10.0 | — | — | 25.0 |

TABLE 10-2

| | lubricant agent (added, wt %) | | average particle |
|---|---|---|---|
| No. | type | addition amount | size (μm) |
| 54 | glycerine<br>stearic acid | 0<br>0 | 73 |
| 55 | glycerine<br>stearic acid | 0.05<br>0.05 | 78 |
| 56 | glycerine<br>stearic acid | 0<br>0 | 65 |
| 57 | glycerine<br>stearic acid | 0.05<br>0.05 | 74 |
| 58 | glycerine<br>stearic acid | 0<br>0 | 94 |
| 59 | glycerine<br>stearic acid | 0<br>0 | 98 |
| 60 | glycerine<br>stearic acid | 0.05<br>0.05 | 97 |
| 61 | glycerine<br>stearic acid | 0<br>0 | 99 |

TABLE 11-1

| | binder (added, wt %) | | solvent content (wt %) | | | |
|---|---|---|---|---|---|---|
| No. | type | addition amount | ethanol | meth-anol | methylene chloride | water |
| 62 | hydroxypropyl methyl cellulose | 0.30 | — | — | — | 35.0 |
| 63 | hydroxypropyl methyl cellulose | 0.30 | 17.5 | — | 17.5 | — |
| 64 | hydroxypropyl methyl celllose | 0.30 | — | 35.0 | — | — |
| 65 | hydroxypropyl methyl cellulose | 0.30 | — | 17.5 | — | 17.5 |
| 66 | hydroxypropyl methyl cellulose<br>carboxylmethyl cellulose ammonium | 0.15<br>0.15 | 17.5 | — | — | 17.5 |
| 67 | methyl cellulose<br>hydroxypropyl methyl cellulose | 0.15<br>0.15 | 17.5 | — | — | 17.5 |
| 68 | ethyl cellulose | 0.30 | 35.0 | — | — | — |
| 69 | benzene cellulose | 0.30 | 35.0 | — | — | — |

TABLE 11-2

| | lubricant agent (added, wt %) | | average particle |
|---|---|---|---|
| No. | type | addition amount | size (μm) |
| 62 | glycerine<br>stearic acid | 0<br>0 | 102 |
| 63 | glycerine<br>stearic acid | 0 | 75 |
| 64 | glycerine<br>stearic acid | 0 | 72 |
| 65 | glycerine<br>stearic acid | 0 | 94 |
| 66 | glycerine<br>stearic acid | 0 | 93 |
| 67 | glycerine<br>stearic acid | 0 | 90 |
| 68 | glycerine<br>stearic acid | 0 | 76 |
| 69 | glycerine<br>stearic acid | 0 | 77 |

TABLE 12

| No. | flowability (sec.) | residual oxygen (ppm) | residual carbon (ppm) | magnetic properties Br (kG) | iHc (kOe) | (BH)max (MGOe) |
|---|---|---|---|---|---|---|
| 54 | 22 | 6500 | 570 | 12.3 | 12.3 | 35.6 |
| 55 | 31 | 6800 | 630 | 12.4 | 12.5 | 36.1 |
| 56 | 26 | 6600 | 580 | 12.4 | 12.7 | 36.1 |
| 57 | 34 | 6900 | 620 | 12.4 | 12.1 | 36.1 |
| 58 | 20 | 7400 | 680 | 12.2 | 12.3 | 35.0 |
| 59 | 20 | 7300 | 680 | 12.2 | 12.5 | 35.1 |
| 60 | 22 | 7600 | 730 | 12.3 | 12.3 | 35.6 |
| 61 | 21 | 7200 | 660 | 12.4 | 12.1 | 36.2 |
| 62 | 23 | 7300 | 640 | 12.5 | 12.0 | 36.8 |
| 63 | 23 | 6400 | 550 | 12.4 | 12.2 | 36.0 |
| 64 | 28 | 6200 | 580 | 12.4 | 12.5 | 36.1 |
| 65 | 20 | 7200 | 650 | 12.2 | 12.9 | 35.2 |
| 66 | 20 | 7300 | 610 | 12.2 | 12.1 | 35.1 |
| 67 | 21 | 7300 | 630 | 12.3 | 12.2 | 35.4 |
| 68 | 23 | 6300 | 550 | 12.3 | 12.6 | 35.5 |
| 69 | 22 | 6400 | 570 | 12.3 | 12.5 | 35.3 |

TABLE 13-1

| No. | binder (added, wt %) type | addition amount | solvent content (wt %) etha-nol | meth-anol | methylene chloride | water |
|---|---|---|---|---|---|---|
| 70 | hydroxypropyl methyl cellulose | 0.20 | 35.0 | — | — | — |
| 71 | hydroxypropyl methyl cellulose | 0.20 | 35.0 | — | — | — |
| 72 | hydroxypropyl methyl cellulose | 0.20 | — | 17.5 | 17.5 | — |
| 73 | hydroxypropyl methyl cellulose | 0.20 | — | 17.5 | 17.5 | — |
| 74 | hydroxyproyl methyl cellulose | 0.30 | 17.5 | — | — | 17.5 |
| 75 | hydroxypropyl methyl cellulose | 0.30 | 10.0 | — | — | 25.0 |
| 76 | hydroxypropyl methyl cellulose | 0.30 | — | — | — | — |
| 77 | hydroxypropyl methyl cellulose | 0.30 | 17.5 | — | 17.5 | — |

TABLE 13-2

| No. | lubricant agent (added, wt %) type | addition amount | average particle size (μm) |
|---|---|---|---|
| 70 | glycerine<br>stearic acid | 0<br>0 | 64 |
| 71 | glycerine<br>stearic acid | 0.05<br>0.05 | 73 |
| 72 | glycerine<br>stearic acid | 0<br>0 | 56 |
| 73 | glycerine<br>stearic acid | 0.05<br>0.05 | 68 |
| 74 | glycerine<br>stearic acid | 0<br>0 | 74 |
| 75 | glycerine<br>stearic acid | 005<br>0.05 | 71 |
| 76 | glycerine<br>stearic acid | 0<br>0 | 78 |
| 77 | glycerine<br>stearic acid | 0<br>0 | 54 |

TABLE 14-1

| No. | binder (added, wt %) type | addition amount | solvent content (wt %) etha-nol | methanol | methylene chloride | water |
|---|---|---|---|---|---|---|
| 78 | hydroxypropyl methyl cellulose | 0.30 | — | 35.0 | — | — |
| 79 | hydroxypropyl methyl cellulose | 0.30 | — | 17.5 | — | 17.5 |
| 80 | hydroxypropyl | 0.15 | 17.5 | — | — | 17.5 |

TABLE 14-1-continued

| No. | binder (added, wt %) type | addition amount | solvent content (wt %) etha-nol | methanol | methylene chloride | water |
|---|---|---|---|---|---|---|
| | methyl cellulose<br>carboxylmethyl cellulose ammonium | 0.15 | | | | |
| 81 | methyl cellulose<br>hydroxypropyl methyl cellulose | 0.15<br>0.15 | 17.5 | — | — | 17.5 |
| 82 | ethyl cellulose | 0.30 | 35.0 | — | — | — |
| 83 | benzene cellulose | 0.30 | 35.0 | — | — | — |

TABLE 14-2

| No. | lubricant agent (added, wt %) type | addition amount | average particle size (μm) |
|---|---|---|---|
| 78 | glycerine<br>stearic acid | 0 | 58 |
| 79 | glycerine<br>stearic acid | 0 | 76 |
| 80 | glycerine<br>stearic acid | 0 | 75 |
| 81 | glycerine<br>stearic acid | 0 | 72 |
| 82 | glycerine<br>stearic acid | 0 | 65 |
| 83 | glycerine<br>stearic acid | 0 | 67 |

TABLE 15

| No. | flowability (sec.) | residual oxygen (ppm) | residual carbon (ppm) | magnetic properties Br (kG) | iHc (kOe) | (BH)max (MGOe) |
|---|---|---|---|---|---|---|
| 70 | 24 | 5200 | 430 | 9.4 | 8.4 | 21.1 |
| 71 | 30 | 5700 | 470 | 9.5 | 7.7 | 21.3 |
| 72 | 27 | 5300 | 450 | 9.5 | 7.8 | 21.4 |
| 73 | 33 | 5800 | 480 | 9.5 | 7.8 | 21.3 |
| 74 | 31 | 5600 | 480 | 9.4 | 7.8 | 20.7 |
| 75 | 33 | 5700 | 560 | 9.5 | 7.5 | 21.1 |
| 76 | 33 | 5700 | 470 | 9.4 | 7.8 | 20.7 |
| 77 | 27 | 5100 | 440 | 9.4 | 8.8 | 21.0 |
| 78 | 31 | 5200 | 420 | 9.4 | 8.5 | 20.8 |
| 79 | 25 | 5600 | 450 | 9.5 | 7.8 | 21.2 |
| 80 | 27 | 5500 | 430 | 9.5 | 8.3 | 21.3 |
| 81 | 26 | 5400 | 440 | 9.5 | 8.2 | 21.1 |
| 82 | 24 | 5200 | 450 | 9.4 | 8.4 | 21.2 |
| 83 | 25 | 5300 | 470 | 9.4 | 8.5 | 21.2 |

TABLE 16-1

| mark | No. | hydrophobic treatment hydrophobic agent | addition amount | binder mixing composition polymer | addition amount | plasticizer | addition amount | slurry conc. (%) |
|---|---|---|---|---|---|---|---|---|
| example | 84 | fluid paraffin | 0.01 | polyethylene oxide | 0.3 | glycerine | 0.10 | 60 |
| | 85 | oleic acid | 0.02 | polyvinyl acetal | 0.3 | glycerine | 0.10 | 65 |

TABLE 16-1-continued

| | | hydrophobic treatment | | binder mixing composition | | | | slurry |
|---|---|---|---|---|---|---|---|---|
| mark | No. | hydrophobic agent | addition amount | polymer | addition amount | plasticizer | addition amount | conc. (%) |
| | 86 | myristic acid | 0.05 | polyacrylic acid | 0.4 | di-ethylene glycol | 0.15 | 65 |
| | 87 | stearyl amide | 0.05 | polyacrylic acid ammonium | 0.5 | ethylene glycol | 0.20 | 65 |
| | 88 | methylene bis-stearo-amide | 0.05 | carboxymethyl cellulose ammonium | 0.2 | glycerine | 0.14 | 55 |
| | 89 | oleic acid butyl | 0.05 | polyvinyl alcohol | 0.30 | glycerine | 0.02 | 65 |
| | 90 | ethylene glycol mono-stearate | 0.05 | polyacryl amide | 0.30 | di-ethylene glycol | 0.10 | 65 |
| | 91 | ricinoleic acid zinc | 0.10 | polyethylene oxide | 0.3 | glycerine | 0.10 | 60 |
| | 92 | stearic acid zinc | 1.00 | polyethylene oxide | 0.3 | glycerine | 0.10 | 60 |
| | 93 | cetyl alcohol | 2.00 | polyethylene oxide | 0.3 | glycerine | 0.10 | 60 |

TABLE 16-2

| | | | | residual | residual | magnetic properties | | |
|---|---|---|---|---|---|---|---|---|
| mark | No. | average particle size (μm) | flowability (sec.) | oxygen (ppm) | carbon (ppm) | Br (kG) | iHc (kOe) | (BH)max (MGOe) |
| example | 84 | 82 | 20 | 5500 | 620 | 12.0 | 12.2 | 33.4 |
| | 85 | 65 | 25 | 5300 | 610 | 12.3 | 12.3 | 33.7 |
| | 86 | 70 | 21 | 5200 | 640 | 12.5 | 12.3 | 34.2 |
| | 87 | 67 | 17 | 5300 | 650 | 12.4 | 12.2 | 33.8 |
| | 88 | 105 | 15 | 5100 | 640 | 12.5 | 12.4 | 34.5 |
| | 89 | 70 | 22 | 5500 | 670 | 12.2 | 12.2 | 33.4 |
| | 90 | 78 | 24 | 5100 | 660 | 12.6 | 12.4 | 34.0 |
| | 91 | 82 | 20 | 5000 | 700 | 12.7 | 12.0 | 33.8 |
| | 92 | 83 | 20 | 5700 | 720 | 12.0 | 11.9 | 33.2 |
| | 93 | 82 | 20 | 6000 | 850 | 12.0 | 11.5 | 33.0 |

TABLE 17-1

| | | hydrophobic treatment | | binder mixing composition | | | | slurry |
|---|---|---|---|---|---|---|---|---|
| mark | No. | hydrophobic agent | addition amount | polymer | addition amount | plasticizer | addition amount | conc. (%) |
| example | 94 | fluid paraffin | 0.01 | polyethylene oxide | 0.3 | glycerine | 0.10 | 60 |
| | 95 | oleic acid | 0.02 | polyvinyl acetal | 0.3 | glycerine | 0.10 | 65 |
| | 96 | myristic acid | 0.05 | polyacrylic acid | 0.4 | di-ethylene glycol | 0.15 | 65 |
| | 97 | stearyl amide | 0.05 | polyacrylic acid ammonium | 0.5 | ethylene glycol | 0.20 | 65 |
| | 98 | methylene bis-stearo-amide | 0.05 | carboxymethyl cellulose ammonium | 0.2 | glycerine | 0.14 | 55 |
| | 99 | oleic acid butyl | 0.05 | polyvinyl alcohol | 0.30 | glycerine | 0.02 | 65 |
| | 100 | ethylene glycol mono-stearate | 0.05 | polyacryl amide | 0.30 | di-ethylene glycol | 0.10 | 65 |

TABLE 17-1-continued

| | | hydrophobic treatment | | binder mixing composition | | | | slurry |
|---|---|---|---|---|---|---|---|---|
| mark | No. | hydrophobic agent | addition amount | polymer | addition amount | plasticizer | addition amount | conc. (%) |
| | 101 | ricinoleic acid zinc | 0.10 | polyethylene oxide | 0.3 | glycerine | 0.10 | 60 |
| | 102 | stearic acid zinc | 1.00 | polyethylene oxide | 0.3 | glycerine | 0.10 | 60 |
| | 103 | cetyl alcohol | 2.00 | polyethylene oxide | 0.3 | glycerine | 0.10 | 60 |

TABLE 17-2

| | | average particle | | residual | residual | magnetic properties | | |
|---|---|---|---|---|---|---|---|---|
| mark | No. | size (μm) | flowability (sec.) | oxygen (ppm) | carbon (ppm) | Br (kG) | iHc (kOe) | (BH)max (MGOe) |
| example | 94 | 80 | 22 | 5400 | 630 | 9.3 | 8.1 | 20.4 |
| | 95 | 72 | 28 | 5200 | 620 | 9.4 | 7.8 | 20.8 |
| | 96 | 58 | 23 | 5400 | 640 | 9.4 | 7.9 | 20.9 |
| | 97 | 62 | 19 | 5600 | 700 | 9.4 | 8.8 | 21.0 |
| | 98 | 95 | 18 | 5100 | 590 | 9.5 | 7.8 | 21.2 |
| | 99 | 82 | 26 | 5300 | 620 | 9.5 | 8.3 | 21.3 |
| | 100 | 79 | 27 | 5400 | 640 | 9.3 | 8.2 | 20.5 |
| | 101 | 82 | 24 | 5300 | 630 | 9.4 | 7.8 | 21.0 |
| | 102 | 80 | 23 | 5200 | 620 | 9.4 | 8.6 | 21.3 |
| | 103 | 80 | 26 | 5400 | 640 | 9.3 | 8.2 | 20.5 |

TABLE 18

| | binder | | | additives | | average |
|---|---|---|---|---|---|---|
| mark | type | addition amount (wt %) | water content (wt %) | type | addition amount (wt %) | particle size (μm) |
| A | polyvinyl alcohol | 0.15 | 35.0 | glycerine | 0.05 | 60 |
| | | | | stearic acid | 0.05 | |
| B | polyvinyl alcohol | 0.08 | 35.0 | glycerine | 0.05 | 68 |
| | polyacryl amide | 0.07 | | stearic acid | 0.05 | |

TABLE 19-1

| | | | | | | press characteristics (n = 20) | |
|---|---|---|---|---|---|---|---|
| | No. | binder | lubricant additive | magnetic field | flowability (sec.) | thickness (mm) | density ($g/cm^3$) |
| comparison | 104 | A | none | static | 37 | max: 10.21<br>min: 10.03 | max: 4.40<br>min: 4.33 |
| | 105 | B | none | static | 35 | max: 10.26<br>min: 10.11 | max: 4.42<br>min: 4.34 |

TABLE 19-1-continued

| | No. | binder | lubricant additive | magnetic field | flowability (sec.) | press characteristics (n = 20) thickness (mm) | density (g/cm$^3$) |
|---|---|---|---|---|---|---|---|
| this invention | 106 | A | yes | static | 36 | max: 10.11<br>min: 10.00 | max: 4.55<br>min: 4.50 |
| | 107 | B | yes | static | 34 | max: 10.16<br>min: 10.03 | max: 4.56<br>min: 4.51 |
| | 108 | A | yes | pulse | 36 | max: 10.12<br>min: 10.02 | max: 4.55<br>min: 4.50 |
| | 109 | B | yes | pulse | 34 | max: 10.17<br>min: 10.04 | max: 4.57<br>min: 4.52 |
| conventional | 110 | none | none | static | not flow | max: 10.10<br>min: 9.90 | max: 4.10<br>min: 3.15 |

TABLE 19-2

| | No. | residual oxygen (ppm) | residual carbon (ppm) | magnetic properties Br (kG) | iHc (kOe) | (BH)max (MGOe) |
|---|---|---|---|---|---|---|
| comparison | 104 | 7300 | 740 | 11.5 | 12.0 | 33.1 |
| | 105 | 7200 | 710 | 11.5 | 11.9 | 32.9 |
| this invention | 106 | 7300 | 750 | 12.5 | 12.1 | 36.0 |
| | 107 | 7200 | 720 | 12.3 | 12.0 | 35.9 |
| | 108 | 7300 | 750 | 13.0 | 12.1 | 38.0 |
| | 109 | 7200 | 720 | 12.9 | 12.0 | 37.6 |
| conventional | 110 | 6500 | 580 | 12.5 | 12.3 | 36.2 |

TABLE 20-1

| | No. | binder | lubricant additive | magnetic field | flowability (sec.) | press characteristics (n = 20) thickness (mm) | density (g/cm$^3$) |
|---|---|---|---|---|---|---|---|
| comparison | 111 | A | none | static | 39 | max: 10.25<br>min: 10.02 | max: 4.62<br>min: 4.56 |
| this invention | 112 | A | yes | static | 38 | max: 10.21<br>min: 10.03 | max: 4.60<br>min: 4.55 |
| | 113 | A | yes | pulse | 38 | max: 10.22<br>min: 10.04 | max: 4.62<br>min: 4.56 |
| conventional | 114 | none | none | static | not flow | max: 10.20<br>min: 7.80 | max: 4.20<br>min: 3.31 |

TABLE 20-2

| | No. | residual oxygen (ppm) | residual carbon (ppm) | magnetic properties Br (kG) | iHc (kOe) | (BH)max (MGOe) |
|---|---|---|---|---|---|---|
| comparison | 111 | 5800 | 430 | 9.5 | 8.4 | 21.0 |
| this invention | 112 | 5800 | 450 | 9.7 | 8.2 | 23.1 |
| | 113 | 5800 | 450 | 9.8 | 8.0 | 23.3 |
| conventional | 114 | 5200 | 380 | 9.6 | 8.5 | 21.9 |

TABLE 21-1

| binder mark | polymer | addition amount | plasticizer | addition amount | slurry conc. (%) |
|---|---|---|---|---|---|
| C | polyethylene oxide | 0.3 | glycerine | 0.10 | 60 |
| D | polyvinyl acetal | 0.3 | glycerine | 0.10 | 65 |
| E | polyacrylic acid | 0.4 | di-ethylene glycol | 0.15 | 65 |

TABLE 21-1-continued

| binder mark | polymer | addition amount | plasticizer | addition amount | slurry conc. (%) |
|---|---|---|---|---|---|
| F | polyacrylic acid ammonium | 0.5 | ethylene glycol | 0.20 | 65 |
| G | carboxymethyl cellulose ammonium | 0.2 | glycerine | 0.14 | 55 |

TABLE 21-2

| mark | average particle size (μm) | yield (%) |
|---|---|---|
| C | 82 | 90 |
| D | 65 | 78 |
| E | 70 | 80 |
| F | 67 | 90 |
| G | 105 | 74 |

TABLE 22-1

| | No. | binder | lubricant additive | magnetic field | flowability (sec.) | press characteristics (n = 20) thickness (mm) | density (g/cm$^3$) |
|---|---|---|---|---|---|---|---|
| comparison | 115 | C | none | static | 37 | max: 10.25<br>min: 10.10 | max: 4.40<br>min: 4.33 |
| | 116 | D | none | static | 39 | max: 10.27<br>min: 10.08 | max: 4.41<br>min: 4.29 |
| | 117 | E | none | static | 36 | max: 10.30<br>min: 10.10 | max: 4.42<br>min: 4.30 |
| | 118 | F | none | static | 37 | max: 10.29<br>min: 10.11 | max: 4.37<br>min: 4.19 |
| | 119 | G | none | static | 40 | max: 10.32<br>min: 10.08 | max: 4.38<br>min: 4.20 |

TABLE 22-2

| | No. | residual oxygen (ppm) | residual carbon (ppm) | magnetic properties Br (kG) | iHc (kOe) | (BH)max (MGOe) |
|---|---|---|---|---|---|---|
| comparison | 115 | 7300 | 730 | 11.5 | 11.9 | 32.4 |
| | 116 | 7100 | 720 | 11.4 | 11.8 | 31.5 |

TABLE 22-2-continued

| No. | residual oxygen (ppm) | residual carbon (ppm) | magnetic properties Br (kG) | iHc (kOe) | (BH)max (MGOe) |
|---|---|---|---|---|---|
| 117 | 7000 | 730 | 11.3 | 11.9 | 31.0 |
| 118 | 7200 | 740 | 11.5 | 11.9 | 32.5 |
| 119 | 7300 | 710 | 11.6 | 11.9 | 32.7 |

TABLE 23-1

| | No. | binder | lubricant additive | magnetic field | flowability (sec.) | press characteristics (n = 20) thickness (mm) | density (g/cm$^3$) |
|---|---|---|---|---|---|---|---|
| example | 120 | C | yes | static | 36 | max: 10.11<br>min: 10.00 | max: 4.55<br>min: 4.50 |
| | 121 | C | yes | static + pulse | 36 | max: 10.16<br>min: 10.03 | max: 4.52<br>min: 4.49 |
| | 122 | D | yes | static | 39 | max: 10.15<br>min: 10.02 | max: 4.54<br>min: 4.48 |
| | 123 | D | yes | static + pulse | 39 | max: 10.10<br>min: 10.00 | max: 4.55<br>min: 4.49 |
| | 124 | E | yes | static | 35 | max: 10.14<br>min: 10.00 | max: 4.56<br>min: 4.49 |
| | 125 | E | yes | static + pulse | 35 | max: 10.18<br>min: 10.05 | max: 4.55<br>min: 4.50 |
| | 126 | F | yes | static | 36 | max: 10.10<br>min: 9.98 | max: 4.55<br>min: 4.48 |
| | 127 | F | yes | static + pulse | 36 | max: 10.12<br>min: 10.02 | max: 4.56<br>min: 4.49 |
| | 128 | G | yes | static | 39 | max: 10.17<br>min: 10.04 | max: 4.54<br>min: 4.47 |
| | 129 | G | yes | static + pulse | 39 | max: 10.18<br>min: 10.08 | max: 4.58<br>min: 4.48 |

TABLE 23-2

| | No. | residual oxygen (ppm) | residual carbon (ppm) | magnetic properties Br (kG) | iHc (kOe) | (BH)max (MGOe) |
|---|---|---|---|---|---|---|
| example | 120 | 7300 | 740 | 12.5 | 12.1 | 36.0 |
| | 121 | 7200 | 710 | 13.0 | 12.0 | 37.9 |
| | 122 | 7300 | 750 | 12.4 | 12.1 | 36.0 |
| | 123 | 7400 | 750 | 12.9 | 12.0 | 37.8 |
| | 124 | 7300 | 740 | 12.4 | 12.3 | 36.2 |
| | 125 | 7300 | 720 | 13.1 | 12.0 | 38.0 |
| | 126 | 7200 | 730 | 12.2 | 11.9 | 36.4 |
| | 127 | 7300 | 720 | 12.9 | 12.1 | 37.8 |
| | 128 | 7200 | 710 | 12.2 | 12.0 | 36.1 |
| | 129 | 7200 | 730 | 12.9 | 11.9 | 37.5 |

TABLE 24-1

| | binder No. | binder type | addition amount (wt %) | water content (wt %) |
|---|---|---|---|---|
| example | a | methyl cellulose | 0.30 | 36 |
| | b | methyl cellulose | 0.15 | 36 |
| | | polyvinyl alcohol | 0.15 | |
| | c | polyvinyl alcohol | 0.30 | 36 |
| | d | polyacrylic amide | 0.30 | 36 |
| | e | polyacrylic amide | 0.15 | 36 |
| | | methyl cellulose | 0.15 | |
| | f | polyacrylic amide | 0.15 | 36 |
| | | polyvinyl alcohol | 0.15 | |
| | g | polyacrylic amide | 0.10 | 36 |
| | | polyvinyl alcohol | 0.10 | |
| | | methyl cellulose | 0.10 | |

TABLE 24-2

| | binder No. | additives type | addition amount (wt %) | average particle size (μm) | flowability (sec.) |
|---|---|---|---|---|---|
| example | a | glycerine | 0.05 | 55 | 21 |
| | | stearic acid | 0.05 | | |
| | b | glycerine | 0.07 | 67 | 20 |
| | | stearic acid | 0.05 | | |
| | c | glycerine | 0.05 | 82 | 19 |
| | | stearic acid | 0.05 | | |
| | d | glycerine | 0.05 | 88 | 22 |
| | | stearic acid | 0.05 | | |
| | e | glycerine | 0.07 | 74 | 20 |
| | | stearic acid | 0.05 | | |
| | f | glycerine | 0.05 | 85 | 18 |
| | | stearic acid | 0.05 | | |
| | g | glycerine | 0.05 | 80 | 17 |
| | | stearic acid | 0.05 | | |

TABLE 25-1

| | No. | binder No. | magnetic field pulse (kOe) | static (kOe) | press characteristics (n = 20) thickness (mm) | density (g/cc) |
|---|---|---|---|---|---|---|
| example | 130 | a | 30 | 10 | max: 10.21 | max: 4.43 |
| | | | | | min: 10.14 | min: 4.39 |
| | 131 | b | 30 | 10 | max: 10.22 | max: 4.42 |
| | | | | | min: 10.18 | min: 4.39 |
| | 132 | c | 30 | 10 | max: 10.21 | max: 4.43 |

TABLE 25-1-continued

| | No. | binder No. | magnetic field pulse (kOe) | static (kOe) | press characteristics (n = 20) thickness (mm) | density (g/cc) |
|---|---|---|---|---|---|---|
| | | | | | min: 10.17 | min: 4.38 |
| | 133 | d | 30 | 10 | max: 10.20 | max: 4.43 |
| | | | | | min: 10.16 | min: 4.39 |
| | 134 | e | 30 | 10 | max: 10.18 | max: 4.45 |
| | | | | | min: 10.14 | min: 4.40 |
| | 135 | f | 30 | 10 | max: 10.20 | max: 4.39 |
| | | | | | min: 10.16 | min: 4.35 |
| | 136 | g | 30 | 10 | max: 10.22 | max: 4.37 |
| | | | | | min: 10.18 | min: 4.38 |
| comparison | 137 | a | 0 | 10 | max: 10.22 | max: 4.42 |
| | | | | | min: 10.15 | min: 4.38 |
| | 138 | b | 0 | 15 | max: 10.23 | max: 4.41 |
| | | | | | min: 10.18 | min: 4.36 |
| | 139 | 3c | 0 | 15 | max: 10.24 | max: 4.42 |
| | | | | | min: 10.17 | min: 4.37 |

TABLE 25-2

| No. | binder No. | residual oxygen and carbon O (ppm) | C (ppm) | magnetic properties Br (kG) | iHc (kOe) | (BH)max (MGOe) |
|---|---|---|---|---|---|---|
| example | | | | | | |
| 130 | a | 8300 | 860 | 12.6 | 12.4 | 37.4 |
| 131 | b | 8400 | 850 | 12.5 | 12.3 | 37.2 |
| 132 | c | 8200 | 840 | 12.5 | 12.8 | 37.1 |
| 133 | d | 8500 | 870 | 12.5 | 12.7 | 37.0 |
| 134 | e | 8400 | 860 | 12.5 | 12.9 | 37.2 |
| 135 | f | 8300 | 840 | 12.6 | 12.1 | 37.4 |
| 136 | g | 8300 | 850 | 12.6 | 12.2 | 37.5 |
| comparison | | | | | | |
| 137 | a | 8400 | 860 | 12.2 | 13.5 | 34.5 |
| 138 | b | 8300 | 830 | 12.3 | 12.6 | 35.1 |
| 139 | 3c | 8100 | 820 | 12.3 | 13.2 | 35.3 |

TABLE 26-1

| mark No. | binder mixing composition polymer | addition amount | plasticizer | addition amount | slurry conc. (%) |
|---|---|---|---|---|---|
| example | | | | | |
| h | polyethylene oxide | 0.3 | glycerine | 0.10 | 60 |
| i | polyvinyl acetal | 0.3 | glycerine | 0.10 | 65 |
| j | polyacrylic acid | 0.4 | di-ethylene glycol | 0.15 | 65 |
| k | polyacrylic acid ammonium | 0.5 | ethylene glycol | 0.20 | 65 |
| l | carboxymethyl cellulose ammonium | 0.2 | glycerine | 0.14 | 55 |

Note: The addition amount of the binder is determined with respect to 100 weight fraction of alloy powders.

TABLE 26-2

| | No. | average particle size (μm) | flowability (sec.) |
|---|---|---|---|
| example | h | 82 | 20 |
| | i | 65 | 25 |
| | j | 70 | 21 |
| | k | 67 | 17 |
| | l | 105 | 15 |

TABLE 27-2-continued

| mark binder No. | No. | residual oxygen (ppm) | residual carbon (ppm) | magnetic properties Br (kG) | iHc (kOe) | (BH)max (MGOe) |
|---|---|---|---|---|---|---|
| k | 143 | 5300 | 650 | 12.6 | 12.5 | 37.3 |
| l | 144 | 5100 | 640 | 11.9 | 12.7 | 36.5 |
| h | 145 | 5500 | 670 | 12.0 | 12.6 | 36.6 |
| h | 146 | 5100 | 660 | 12.3 | 12.4 | 36.8 |
| h | 147 | 5000 | 700 | 12.5 | 12.3 | 37.0 |

TABLE 27-1

| mark binder No. | No. | initial pulse conditions strength (kOe) | cycles | magnetic field conditions for press-forming: pulse field strength (kOe) | cycles | static field strength (kOe) | magnetic field pattern |
|---|---|---|---|---|---|---|---|
| example | | | | | | | |
| h | 140 | 30 | 1 | — | — | 15 | static magnetic field only |
| i | 141 | 30 | 1 | — | — | 15 | static magnetic field only |
| j | 142 | 30 | 1 | — | — | 15 | static magnetic field only |
| k | 143 | 30 | 1 | — | — | 12 | static magnetic field only |
| l | 144 | 30 | 1 | — | — | 8 | static magnetic field only |
| h | 145 | 15 | 1 | — | — | 15 | static magnetic field only |
| h | 146 | 20 | 1 | — | — | 15 | static magnetic field only |
| h | 147 | 25 | 1 | — | — | 15 | static magnetic field only |
| h | 148 | 30 | 2 | — | — | 15 | static magnetic field only |
| h | 149 | 30 | 3 | — | — | 15 | static magnetic field only |
| h | 150 | 30 | 4 | — | — | 15 | static magnetic field only |
| h | 151 | 30 | 1 | 15 | 1 | 15 | pulse field superimposed over static field |
| h | 152 | 30 | 1 | 15 | 1 | 15 | alternative application of pulse and static fields |
| h | 153 | 30 | 1 | 30 | 3 | — | pulse field only |

TABLE 27-2

| mark binder No. | No. | residual oxygen (ppm) | residual carbon (ppm) | magnetic properties Br (kG) | iHc (kOe) | (BH)max (MGOe) |
|---|---|---|---|---|---|---|
| example | | | | | | |
| h | 140 | 5500 | 620 | 12.6 | 12.8 | 37.3 |
| i | 141 | 5300 | 610 | 12.5 | 12.3 | 37.2 |
| j | 142 | 5200 | 640 | 12.4 | 12.9 | 37.2 |

TABLE 27-2-continued

| mark binder No. | No. | residual oxygen (ppm) | residual carbon (ppm) | magnetic properties Br (kG) | iHc (kOe) | (BH)max (MGOe) |
|---|---|---|---|---|---|---|
| h | 148 | 5700 | 720 | 12.7 | 12.4 | 37.4 |
| h | 149 | 5700 | 650 | 12.7 | 12.3 | 37.3 |
| h | 150 | 5700 | 660 | 12.7 | 12.4 | 37.4 |
| h | 151 | 5800 | 620 | 12.0 | 12.0 | 36.8 |
| h | 152 | 5700 | 620 | 12.6 | 11.9 | 37.2 |
| h | 153 | 5600 | 650 | 12.6 | 12.0 | 37.0 |

TABLE 28-1

| mark No. | binder mixing composition: polymer break strength (kgf/mm$^2$) | addition amount | plasticizer | addition amount | solvent | slurry conc. (%) |
|---|---|---|---|---|---|---|
| example | | | | | | |
| m | polymethyl methacrylate 0.65 | 0.5 | none | — | toluene | 60 |
| n | polyvinyl acetal 1.0 | 0.3 | none | — | dioxane | 65 |
| o | ethylene-methyl methacrylate copolymer 0.55 | 0.4 | none | — | xylene/dicho lorethane (1/1) | 65 |

TABLE 28-1-continued

| mark No. | binder mixing composition: polymer break strength (kgf/mm$^2$) | addition amount | plasticizer | addition amount | solvent | slurry conc. (%) |
|---|---|---|---|---|---|---|
| p | polycarbonate 3.5 | 0.1 | di-butyl phthalate | 0.02 | dicholoroethane | 65 |
| q | polyvinyl butylate 4.0 | 0.3 | di-octyl adipate | 0.10 | dioxane | 55 |
| r | polyacrylate 4.5 | 0.3 | butyl phthalyl butyl glycolate | 0.25 | benzene | 65 |

Note: The addition amount of the binder is determined with respect to 100 weight fraction of alloy powders.

TABLE 28-2

| | No. | average particle size (μm) | flowability (sec) |
|---|---|---|---|
| example | m | 75 | 21 |
| | n | 68 | 18 |
| | o | 55 | 19 |
| | p | 40 | 18 |
| | q | 80 | 17 |
| | r | 65 | 19 |

TABLE 29-2-continued

| mark binder No. | No. | residual oxygen (ppm) | residual carbon (ppm) | magnetic properties Br (kG) | iHc (kOe) | (BH)max (MGOe) |
|---|---|---|---|---|---|---|
| o | 156 | 4300 | 610 | 12.5 | 12.8 | 37.2 |
| p | 157 | 5000 | 680 | 12.4 | 12.4 | 37.1 |
| q | 158 | 5000 | 690 | 12.1 | 12.6 | 36.4 |
| r | 159 | 4800 | 700 | 12.1 | 12.7 | 36.5 |
| q | 160 | 5000 | 710 | 11.8 | 12.9 | 36.6 |

TABLE 29-1

| mark binder No. | No. | initial pulse conditions: strength (kOe) | cycles | magnetic filed conditions for press-forming: pulse field: strength (kOe) | cycles | static field: strength (KOe) | magnetic field pattern |
|---|---|---|---|---|---|---|---|
| example | | | | | | | |
| m | 154 | 30 | 1 | — | — | 15 | static magnetic field only |
| n | 155 | 30 | 1 | — | — | 15 | static magnetic field only |
| o | 156 | 30 | 1 | — | — | 15 | static magnetic field only |
| p | 157 | 30 | 1 | — | — | 12 | static magnetic field only |
| q | 158 | 30 | 1 | — | — | 15 | static magnetic field only |
| r | 159 | 30 | 1 | — | — | 8 | static magnetic field only |
| q | 160 | 15 | 1 | — | — | 15 | static magnetic field only |
| q | 161 | 20 | 1 | — | — | 15 | static magnetic field only |
| q | 162 | 25 | 1 | — | — | 15 | static magnetic field only |
| q | 163 | 30 | 2 | — | — | 15 | static magnetic field only |
| q | 164 | 30 | 3 | — | — | 15 | static magnetic field only |
| q | 165 | 30 | 4 | — | — | 15 | static magnetic field only |
| q | 166 | 30 | 1 | 15 | 1 | 15 | pulse field superimposed over static field |
| q | 167 | 30 | 1 | 15 | 1 | 15 | alternative application of static and pulse fields |
| q | 168 | 30 | 1 | 30 | 3 | — | pulse field only |

TABLE 29-2

| mark binder No. | No. | residual oxygen (ppm) | residual carbon (ppm) | magnetic properties Br (kG) | iHc (kOe) | (BH)max (MGOe) |
|---|---|---|---|---|---|---|
| example | | | | | | |
| m | 154 | 4900 | 630 | 12.5 | 12.8 | 37.3 |
| n | 155 | 4500 | 640 | 12.6 | 12.2 | 37.2 |

TABLE 29-2-continued

| mark binder No. | No. | residual oxygen (ppm) | residual carbon (ppm) | magnetic properties Br (kG) | iHc (kOe) | (BH)max (MGOe) |
|---|---|---|---|---|---|---|
| q | 161 | 5000 | 690 | 12.4 | 12.5 | 36.9 |
| q | 162 | 4800 | 670 | 12.6 | 12.4 | 37.1 |
| q | 163 | 4900 | 690 | 12.8 | 12.5 | 37.4 |
| q | 164 | 4800 | 690 | 12.7 | 12.6 | 37.5 |

TABLE 29-2-continued

| mark | | residual | residual | magnetic properties | | |
|---|---|---|---|---|---|---|
| binder No. | No. | oxygen (ppm) | carbon (ppm) | Br (kG) | iHc (kOe) | (BH)max (MGOe) |
| q | 165 | 4700 | 680 | 12.9 | 12.4 | 37.6 |
| q | 166 | 4800 | 670 | 12.1 | 12.1 | 36.9 |
| q | 167 | 4700 | 680 | 12.6 | 11.9 | 37.2 |
| q | 168 | 4800 | 690 | 12.1 | 12.0 | 36.5 |

TABLE 30-1

| | binder mixing composition | | | | | |
|---|---|---|---|---|---|---|
| binder No. | polymer | addition amount | plasticizer | addition amount | solvent | slurry conc. (%) |
| s | polyvinyl alcohol | 0.3 | glycerine | 0.10 | water | 65 |
| t | polymethyl methacrylate | 0.5 | none | — | toluene | 60 |
| u | polyvinyl butylate | 0.3 | di-butyl phthalate | 0.10 | dioxane | 60 |
| v | polyethylene oxide | 0.3 | glycerine | 0.10 | water | 60 |
| w | polyvinyl acetal | 0.3 | glycerine | 0.10 | water | 65 |
| x | polyacrylic acid | 0.4 | di-ethylene glycol | 0.15 | water | 65 |
| y | polyacrylic acid | 0.5 | ethylene glycol | 0.20 | water | 65 |

TABLE 30-1-continued

| | binder mixing composition | | | | | |
|---|---|---|---|---|---|---|
| binder No. | polymer | addition amount | plasticizer | addition amount | solvent | slurry conc. (%) |
| | ammonium | | | | | |

TABLE 30-2

| binder No. | flowability (sec.) | average particle size (μm) |
|---|---|---|
| s | 23 | 62 |
| t | 22 | 51 |
| u | 24 | 68 |
| v | 24 | 65 |
| w | 21 | 48 |
| x | 23 | 40 |
| y | 26 | 52 |

TABLE 31-1

| | | magnetic field conditions for press-forming | | | |
|---|---|---|---|---|---|
| mark | | pulse field | | static field | |
| binder No. | No. | strength (kOe) | cycles | strength (kOe) | magnetic field pattern |
| example | | | | | |
| s | 169 | — | — | 15 | static field only |
| t | 170 | — | — | 15 | static field only |
| u | 171 | — | — | 15 | static field only |
| t | 172 | 15 | 1 | 15 | pulse field superimposed over the static field |
| t | 173 | 15 | 1 | 15 | alternative application of static and pulse fields |
| t | 174 | 30 | 3 | — | pulse field only |
| example | | | | | |
| v | 175 | — | — | 15 | static field only |
| w | 176 | 15 | 1 | 15 | pulse field superimposed over static field |
| x | 177 | 15 | 1 | 15 | alternative application of static and pulse fields |
| y | 178 | 30 | 3 | — | pulse field only |

TABLE 31-2

| mark | | initial pulse conditions | | residual | residual | magnetic properties | | |
|---|---|---|---|---|---|---|---|---|
| binder No. | No. | strength (kOe) | cycles | oxygen (ppm) | carbon (ppm) | Br (kG) | iHc (kOe) | (BH)max (MGOe) |
| example | | | | | | | | |
| s | 169 | 30 | 1 | 5900 | 480 | 9.4 | 8.1 | 20.4 |
| t | 170 | 30 | 1 | 6800 | 490 | 9.2 | 8.0 | 20.6 |
| u | 171 | 30 | 1 | 5300 | 470 | 9.3 | 7.8 | 20.2 |
| t | 172 | 30 | 1 | 7000 | 470 | 9.4 | 8.0 | 20.8 |
| t | 173 | 30 | 1 | 6800 | 480 | 9.6 | 8.1 | 21.0 |
| t | 174 | 30 | 1 | 6700 | 490 | 9.3 | 7.9 | 20.6 |
| example | | | | | | | | |
| v | 175 | 30 | 1 | 6000 | 480 | 9.3 | 8.1 | 20.4 |
| w | 176 | 30 | 1 | 7000 | 470 | 9.5 | 8.1 | 20.8 |
| x | 177 | 30 | 1 | 6800 | 480 | 9.5 | 8.0 | 21.1 |
| y | 178 | 30 | 1 | 6700 | 490 | 9.4 | 7.9 | 20.5 |

TABLE 32

| | binder mixing composition | | | | |
|---|---|---|---|---|---|
| No. | polymer | addition amount | plasticizer | addition amount | slurry conc. (%) |
| 179 | polyethylene oxide | 0.3 | glycerine | 0.10 | 60 |
| 180 | polyvinyl acetal | 0.3 | glycerine | 0.10 | 65 |
| 181 | polyacrylic acid | 0.4 | di-ethylene glycol | 0.15 | 65 |
| 182 | polyacryl acid ammonium | 0.5 | ethylene glycol | 0.20 | 65 |
| 183 | carboxymethyl cellulose ammonium | 0.2 | glycerine | 0.14 | 55 |
| 184 | polyvinyl alcohol | 0.30 | glycerine | 0.02 | 65 |
| 185 | polyacryl amide | 0.30 | di-ethylene glycol | 0.10 | 65 |
| 186 | polyethylene oxide | 0.3 | glycerine | 0.10 | 60 |
| 187 | polyethylene oxide | 0.3 | glycerine | 0.10 | 60 |
| 188 | polyethylene oxide | 0.3 | glycerine | 0.10 | 60 |
| 189 | polyethylene oxide | 0.3 | glycerine | 0.10 | 60 |
| 190 | polyethylene oxide | 0.3 | glycerine | 0.10 | 60 |
| 191 | polyethylene oxide | 0.3 | glycerine | 0.10 | 60 |

45

TABLE 33

| | | | | ultrasonic oscillation conditions | | | |
|---|---|---|---|---|---|---|---|
| No. | average particle size (μm) | yield (%) | flowability (sec.) | pressure ($kg/cm^2$) | frequency (kHz) | oscillation time (sec) | amplitude (μm) |
| 179 | 82 | 90 | 20 | 15 | 20 | 0.5 | 20 |
| 180 | 65 | 78 | 25 | 15 | 20 | 1.0 | 20 |
| 181 | 70 | 80 | 21 | 15 | 20 | 2.0 | 20 |
| 182 | 67 | 90 | 17 | 15 | 20 | 3.0 | 20 |
| 183 | 105 | 74 | 15 | 1 | 20 | 1.0 | 20 |
| 184 | 70 | 82 | 22 | 90 | 20 | 1.0 | 20 |
| 185 | 78 | 66 | 24 | 15 | 40 | 1.0 | 5 |
| 186 | 82 | 90 | 20 | 15 | 10 | 1.0 | 90 |
| 187 | 82 | 90 | 20 | 15 | 20 | 1.0 | 20 |
| 188 | 82 | 90 | 20 | 110 | 20 | 1.0 | 20 |
| 189 | 82 | 90 | 20 | 15 | 8 | 3.0 | 20 |
| 190 | 82 | 90 | 20 | 15 | 50 | 2.0 | 20 |
| 191 | 82 | 90 | 20 | 15 | 10 | 1.0 | 110 |

TABLE 34-1

| No. | press-forming pressure (ton/cm$^2$) | press-formability (n = 20) thickness (mm) | density (g/cm$^3$) | residual oxygen (ppm) | residual carbon (ppm) |
|---|---|---|---|---|---|
| 179 | 1 | max:10.10 | max:4.45 | 6800 | 680 |
| | | min:10.01 | min:4.41 | | |
| 180 | 1 | max:10.14 | max:4.45 | 6900 | 700 |
| | | min:10.02 | min:4.39 | | |
| 181 | 1 | max:10.11 | max:4.45 | 6900 | 710 |
| | | min:10.03 | min:4.44 | | |
| 182 | 1 | max:10.16 | max:4.42 | 6800 | 700 |
| | | min:10.06 | min:4.38 | | |
| 183 | 1 | max:10.08 | max:4.47 | 6900 | 640 |
| | | min:10.00 | min:4.41 | | |
| 184 | 1 | max:10.11 | max:4.45 | 6800 | 670 |
| | | min:10.04 | min:4.40 | | |
| 185 | 1 | max:10.10 | max:4.45 | 6700 | 660 |

TABLE 34-2

| No. | magnetic properties Br (kG) | iHC (kOe) | (BH)max (MGOe) |
|---|---|---|---|
| 179 | 12.9 | 14.2 | 37.1 |
| 180 | 12.9 | 14.3 | 37.7 |
| 181 | 12.8 | 14.3 | 37.2 |
| 182 | 12.9 | 14.1 | 37.3 |
| 183 | 13.0 | 14.2 | 37.7 |
| 184 | 12.9 | 14.2 | 37.4 |
| 185 | 12.9 | 14.2 | 37.4 |
| 186 | 12.9 | 14.2 | 37.4 |
| 187 | 12.9 | 14.2 | 37.3 |
| 188 | 11.8 | 14.1 | 35.4 |
| 189 | 11.6 | 14.1 | 35.2 |
| 190 | 11.5 | 14.4 | 35.3 |
| 191 | 10.5 | 12.0 | 24.9 |

TABLE 35

| mark No. | binder mixing composition break strength (kgf/mm$^2$) | addition amount | plasticizer | addition amount | solvent | slurry conc. (%) | flowability (sec.) |
|---|---|---|---|---|---|---|---|
| example | | | | | | | |
| 192 | polymethyl methacrylate 0.65 | 0.5 | none | — | toluene | 60 | 21 |
| 193 | polyvinyl acetal 1.0 | 0.3 | none | — | dioxane | 65 | 18 |
| 194 | ethylene-methyl methacrylate co-polymer 0.55 | 0.4 | none | — | xylene/dichloroethane(1/1) | 65 | 19 |
| 195 | polycarbonate 3.5 | 0.1 | di-butyl phthalate | 0.02 | dicholoroethane | 65 | 18 |
| 196 | polyvinyl butylate 4.0 | 0.3 | di-octyl adipate | 0.10 | dioxane | 55 | 17 |
| 197 | polyacrylate 4.5 | 0.3 | butylphtalyl butyl glycolate | 0.25 | benzene | 65 | 19 |
| 198 | polyvinyl butylate 4.0 | 0.3 | di-octyl adipate | 0.10 | dioxane | 55 | 17 |
| 203 | | | | | | | |

TABLE 34-1-continued

| No. | press-forming pressure (ton/cm$^2$) | press-formability (n = 20) thickness (mm) | density (g/cm$^3$) | residual oxygen (ppm) | residual carbon (ppm) |
|---|---|---|---|---|---|
| | | min:10.05 | min:4.40 | | |
| 186 | 1 | max:10.12 | max:4.41 | 6800 | 700 |
| | | min:10.03 | min:4.38 | | |
| 187 | 1 | max:10.09 | max:4.45 | 6700 | 700 |
| | | min:10.05 | min:4.41 | | |
| 188 | 1 | max:10.21 | max:4.31 | 6700 | 690 |
| | | min:10.13 | min:4.28 | | |
| 189 | 1 | max:10.21 | max:4.31 | 6800 | 690 |
| | | min:10.13 | min:4.28 | | |
| 190 | 1 | max:10.20 | max:4.30 | 6800 | 690 |
| | | min:9.90 | min:4.25 | | |
| 191 | 1 | max:10.50 | max:4.39 | 8500 | 700 |
| | | min:9.80 | min:4.10 | | |

TABLE 36-1

| mark No. | ultrasonic oscillation conditions pressure (kg/cm$^2$) | frequency (kHz) | oscillation time (sec) | amplitude ($\mu$m) |
|---|---|---|---|---|
| example | | | | |
| 192 | 15 | 20 | 0.5 | 20 |
| 193 | 15 | 20 | 1.0 | 20 |
| 194 | 15 | 20 | 2.0 | 20 |
| 195 | 15 | 20 | 3.0 | 20 |
| 196 | 1 | 20 | 1.0 | 20 |
| 197 | 90 | 20 | 1.0 | 20 |
| 198 | 15 | 40 | 1.0 | 5 |
| 199 | 15 | 10 | 1.0 | 90 |
| comparison | | | | |
| 200 | 110 | 20 | 1.0 | 20 |

TABLE 36-1-continued

| mark No. | ultrasonic oscillation conditions: pressure (kg/cm$^2$) | frequency (kHz) | oscillation time (sec) | amplitude ($\mu$m) |
|---|---|---|---|---|
| 201 | 15 | 8 | 3.0 | 20 |
| 202 | 15 | 50 | 2.0 | 20 |
| 203 | 15 | 10 | 1.0 | 110 |

TABLE 36-2

| mark No. | residual oxygen (ppm) | residual carbon (ppm) | magnetic properties: Br (kG) | iHc (kOe) | (BH)max (MGOe) |
|---|---|---|---|---|---|
| example | | | | | |
| 192 | 5200 | 680 | 12.9 | 12.2 | 35.1 |
| 193 | 5300 | 690 | 12.9 | 12.3 | 35.4 |
| 194 | 5300 | 680 | 12.8 | 12.3 | 35.2 |
| 195 | 5200 | 700 | 12.9 | 12.1 | 34.9 |
| 196 | 5300 | 660 | 12.8 | 12.3 | 36.0 |
| 197 | 5200 | 670 | 12.7 | 12.2 | 35.0 |
| 198 | 5200 | 660 | 12.7 | 12.2 | 35.1 |
| 199 | 5200 | 670 | 12.7 | 12.3 | 35.2 |
| comparison | | | | | |
| 200 | 5300 | 660 | 12.4 | 12.0 | 33.8 |
| 201 | 5200 | 660 | 12.5 | 12.2 | 33.6 |
| 202 | 5200 | 670 | 12.4 | 12.2 | 33.5 |
| 203 | 8800 | 670 | 10.5 | 12.0 | 24.9 |

TABLE 37

| No. | binder mixing composition: polymer break strength | addition amount | plasticizer | addition amount | solvent | slurry conc. (%) | flowability (sec) |
|---|---|---|---|---|---|---|---|
| 204 | polyvinyl alcohol 4.7 kgf/mm$^2$ | 0.3 | glycerine | 0.10 | water | 65 | 23 |
| 205 | polymethyl methacrylate 0.55 kgf/mm$^2$ | 0.5 | none | — | toluene | 60 | 22 |
| 206 | polyvinyl butylate | 0.3 | di-butyl phthalate | 0.10 | dioxane | 60 | 24 |

Note: The addition amount of the binder is determined with respect to 100 weight fraction of alloy powders.

TABLE 38-1

| No. | ultrasonic oscillation conditions: pressure (kgf/mm$^2$) | frequency (kHz) | oscillation time (sec) | amplitude ($\mu$m) |
|---|---|---|---|---|
| 204 | 15 | 20 | 1.0 | 20 |
| 205 | 15 | 20 | 1.0 | 20 |
| 206 | 15 | 20 | 1.0 | 20 |

TABLE 38-1-continued

| No. | ultrasonic oscillation conditions: pressure (kgf/mm$^2$) | frequency (kHz) | oscillation time (sec) | amplitude ($\mu$m) |
|---|---|---|---|---|
| 207 | — | ultrasonic vibration | oscillation | none |

TABLE 38-2

| No. | residual oxygen (ppm) | residual carbon (ppm) | magnetic properties: Br (kG) | iHc (kOe) | (BH)max (MGOe) |
|---|---|---|---|---|---|
| 204 | 6800 | 480 | 9.3 | 7.8 | 20.2 |
| 205 | 5900 | 510 | 9.4 | 8.1 | 20.9 |
| 206 | 5300 | 470 | 9.5 | 8.2 | 21.9 |
| 207 | 6900 | 470 | 8.7 | 7.8 | 19.3 |

TABLE 39

| No. | binder mixing composition: polymer | addition amount | plasticizer | addition amount | slurry conc. (%) |
|---|---|---|---|---|---|
| 208 | polyethylene oxide | 0.3 | glycerine | 0.10 | 60 |
| 209 | polyvinyl acetal | 0.3 | glycerine | 0.10 | 65 |
| 210 | polyacrylic acid | 0.4 | di-ethylene glycol | 0.15 | 65 |

TABLE 39-continued

| | binder mixing composition | | | | |
|---|---|---|---|---|---|
| No. | polymer | addition amount | plasticizer | addition amount | slurry conc. (%) |
| 211 | polyacryl acid ammonium | 0.5 | ethylenel glycol | 0.20 | 65 |
| 212 | polyethylene oxide | 0.3 | glycerine | 0.10 | 60 |
| 213 | polyethylene oxide | 0.3 | glycerine | 0.10 | 60 |

TABLE 40

| | average | | | ultrasonic oscillation conditions | | | |
|---|---|---|---|---|---|---|---|
| No. | particle size (μm) | yield (%) | flowability (sec.) | pressure (kgf/mm$^2$) | frequency (kHz) | oscillation time (sec) | amplitude (μm) |
| 208 | 73 | 89 | 22 | 15 | 20 | 0.5 | 20 |
| 209 | 54 | 81 | 27 | 15 | 10 | 1.0 | 20 |
| 210 | 63 | 87 | 22 | 15 | 20 | 2.0 | 20 |
| 211 | 60 | 91 | 18 | 15 | 20 | 3.0 | 20 |
| 212 | 74 | 88 | 22 | 110 | 20 | 1.0 | 20 |
| 213 | 72 | 91 | 23 | 15 | 8 | 3.0 | 20 |

TABLE 41-1

| | press-forming | press-formability (n = 20) | |
|---|---|---|---|
| No. | pressure (ton/cm$^2$) | thickness (mm) | density (g/cm$^3$) |
| 208 | 1 | max:10.10<br>min:10.03 | max:4.45<br>min:4.42 |
| 209 | 1 | max:10.16<br>min:10.04 | max:4.45<br>min:4.38 |
| 210 | 1 | max:10.12<br>min:10.03 | max:4.45<br>min:4.40 |
| 211 | 1 | max:10.15<br>min:10.08 | max:4.45<br>min:4.40 |
| 212 | 1 | max:10.25<br>min:10.13 | max:4.36<br>min:4.27 |
| 213 | 1 | max:10.21<br>min:10.12 | max:4.35<br>min:4.27 |

TABLE 41-2

| | residual | residual | magnetic properties | | |
|---|---|---|---|---|---|
| No. | oxygen (ppm) | carbon (ppm) | Br (kG) | iHc (kOe) | (BH)max (MGOe) |
| 208 | 5700 | 480 | 9.5 | 8.7 | 21.4 |
| 209 | 5800 | 490 | 9.5 | 8.3 | 21.3 |
| 210 | 5800 | 460 | 9.5 | 8.3 | 21.4 |
| 211 | 5600 | 480 | 9.5 | 8.4 | 21.4 |
| 212 | 5600 | 480 | 9.2 | 8.7 | 19.8 |
| 213 | 5700 | 470 | 9.2 | 8.8 | 19.9 |

Industrial Applicability

According to the present invention, the granulated powders which are needed to produce rare-earth system sintered magnets having an excellent magnetic characteristics can be easily prepared. The chemical reaction of rare-earth system alloy powders with the binder can be controlled, so that residual oxygen and carbon levels in the sintered body can be reduced. Moreover, the flowablity and lubricant capability of the powders during the forming can be enhanced, and dimension accuracy and productivity can be improved. Hence, the present invention can provide rare-earth system system sintered magnets such as R—Fe—B or R—Co system having excellent magnetic properties and unique configuration of a small size, thin wall thickness, and intricate geometry. For example, the present invention is the most suitable to produce a high efficient permanent magnet with a thin wall thickness and irregular geometry such as a magnet used for a photo-angulator.

While this invention has been described in detail with respect to preferred embodiments and examples, it should be understood that the invention is not limited to that precise examples; rather many modifications, and variations would present themselves to those of skill in the art without departing from the scope and spirit of this invention, as defined in the appended claims.

What is claimed is:

1. A method for producing a rare-earth sintered magnet comprising the steps of:

(a) adding binder containing at least one polymer and an organic solvent to a rare-earth alloy powder to form a mixture;

(b) kneading said mixture to form a slurry;

(c) forming said slurry into granules using a spray-dryer means; and (d) molding and sintering said granules by a powder metallurgy technique to produce the sintered magnet.

2. A method for preparing a rare-earth sintered magnet as claimed in claim 1, wherein said rare-earth alloy powder is an R—Fe—b alloy powder.

3. A method for preparing a rare-earth sintered magnet as claimed in claim 1, wherein said rare-earth alloy powder is an R—Co alloy powder.

4. A method for preparing a rare-earth sintered magnet as claimed in claim 1, wherein said rare-earth alloy powder contains particles having an average size of 1 to 10 μm.

5. A method for preparing a rare-earth sintered magnet as claimed in claim 1, wherein said rare-earth alloy powder contains particles having an average size of 1 to 6 μm.

6. A method for preparing a rare earth sintered magnet as claimed in claim 1, wherein said binder includes water.

7. A method for preparing a rare-earth sintered magnet as claimed in claim 1, wherein said binder includes ethylene chloride.

8. A method for preparing a rare-earth sintered magnet as claimed in claim 1, wherein in step (a) said binder is added in a range of 0.05 to 0.7 wt % with respect to 100 wt % of the rare-earth alloy powder.

9. A method for preparing a rare-earth sintered magnet as claimed in claim 8, wherein in step (a) said binder is added in a range of 0.05 to 0.5 wt % with respect to 100 wt % of the rare-earth alloy powder.

10. A method for preparing a rare-earth sintered magnet as claimed in claim 1, wherein a plasticizer is added to said binder.

11. A method for preparing a rare-earth sintered magnet as claimed in claim 10, wherein said plasticizer is added in a range of 2 to 100 wt % with respect to 100 wt % of polymers contained in said binder.

12. A method for preparing a rare-earth sintered magnet as claimed in claim 11, wherein said plasticizer is added in a range of 5 to 70 wt % with respect to 100 wt % of the polymers contained in said binder.

13. A method for preparing a rare-earth sintered magnet as claimed in claim 1, wherein steps (a) and (b) are performed at a temperature range of 0 to 30° C.

14. A method for preparing a rare-earth sintered magnet as claimed in claim 1, wherein steps (a) and (b) are performed in closed conditions.

15. A method for preparing a rare-earth sintered magnet as claimed in claim 1, wherein an average particle size of said granulated powders is in a range of 10 to 400 $\mu$m.

16. A method for preparing a rare-earth sintered magnet as claimed in claim 15, wherein an average particle size of said granulated powders is in a range of 40 to 200 $\mu$m.

17. A method for preparing a rare-earth sintered magnet as claimed in claim 1, including adding aliphatic acid ester or at least one type of boric acid ester compounds to said granulated powders prior to step (d).

18. A method for preparing a rare-earth sintered magnet as claimed in claim 17, wherein a pulse magnetic field more than 10 kOe is applied to said granulated powders more than one time prior to step (d).

19. A method for preparing a rare-earth sintered magnet as claimed in claim 17, wherein said aliphatic acid ester or boric acid ester compounds is added in a range of 0.01 to 2.0 wt % with respect to 100 wt % of the granulated powders.

20. A method for preparing a rare-earth sintered magnet as claimed in claim 19, wherein said aliphatic acid ester or boric acid ester compounds is added in a range of 0.01 to 1.0 wt % with respect to 100 wt % of the granulated powders.

21. A method for preparing a rare-earth sintered magnet as claimed in claim 1, wherein in step (d) said granulated powders are molded by crushing into primary particles orienting the primary particles, and molding under a static and/or pulse magnetic field.

22. A method for preparing a rare-earth sintered magnet as claimed in claim 21, wherein the strength of the pulse magnet field applied prior to molding is more than 15 kOe, the strength of the static magnetic field is 8 15 kOe and/or the pulse magnet field applied during the molding is more than 15 kOe.

23. A method for preparing a rare-earth sintered magnet as claimed in claim 1, wherein, after the granulated powders are fed into a press mold in which said granulated powders are subjected to be pressed with a punch, said granulated powders are pressed under a pressure less than 100 kg/cm$^2$ for more than 0.5 seconds while applying ultrasonic vibration with less than 100 $\mu$m of amplitude to said mold and/or punch, followed by stopping the applied ultrasonic vibration and subsequent molding with a pressure more than 100 kg/cm$^2$.

* * * * *